US006553782B1

(12) United States Patent
Kyees

(10) Patent No.: US 6,553,782 B1
(45) **Date of Patent: *Apr. 29, 2003**

(54) APPARATUS FOR COOLING FLUIDS

(75) Inventor: Melvin D Kyees, Huntington Beach, CA (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/691,731

(22) Filed: Oct. 18, 2000

Related U.S. Application Data

(63) Continuation of application No. 08/615,399, filed on Mar. 14, 1996, now abandoned, which is a continuation-in-part of application No. 08/531,568, filed on Sep. 13, 1995, now Pat. No. 5,743,107.

(51) Int. Cl.[7] ..... B67D 5/62
(52) U.S. Cl. ..... 62/390; 62/396
(58) Field of Search ..... 62/390, 396, 98, 62/389, 393, 430, 434; 222/146.6

(56) References Cited

U.S. PATENT DOCUMENTS

| | | | | |
|---|---|---|---|---|
| 1,899,629 A | | 2/1933 | Morse | |
| 1,965,553 A | | 7/1934 | Lear | |
| 1,969,643 A | | 8/1934 | Fuchs et al. | |
| 2,267,819 A | | 12/1941 | Di Pietro | |
| 2,766,019 A | | 10/1956 | Adams et al. | |
| 2,771,752 A | | 11/1956 | Tennant | |
| 4,617,807 A | | 10/1986 | Pritchett et al. | |
| 4,679,408 A | | 7/1987 | Nelson | |
| 4,730,463 A | | 3/1988 | Stanfill | |
| 5,484,015 A | | 1/1996 | Kyees | |
| 5,564,602 A | | 10/1996 | Cleland et al. | |
| 5,694,787 A | | 12/1997 | Cleleand et al. | |
| 5,743,107 A | * | 4/1998 | Kyees | 62/390 |
| 6,098,418 A | | 8/2000 | Kyees | |

FOREIGN PATENT DOCUMENTS

| | | |
|---|---|---|
| WO | WO 97/10171 | 3/1997 |

OTHER PUBLICATIONS

Webster's New World Dictionary Thrid College Edition, 1998, Webster's New World, Cleveland and New York pp. 822, 823, 1229.

* cited by examiner

*Primary Examiner*—William C. Doerrler
(74) *Attorney, Agent, or Firm*—Steven P. Shurtz; Brinks Hofer Gilson & Lione

(57) ABSTRACT

An apparatus for cooling at least one fluid includes separable cold plate and dispenser units. The cold plate unit includes a coolant system, a fluid system and a metallic unit. The coolant system defines a cold plate portion and a tower portion. The cold plate portion of the coolant system has a primary inlet manifold and a primary outlet manifold, and the tower portion has a secondary inlet manifold and a secondary outlet manifold. The coolant system further includes a first plurality of coolant line segments connecting the primary and secondary inlet manifolds and a second plurality of coolant line segments connecting the secondary and primary outlet manifolds. The fluid system also defines a cold plate portion and a tower portion, the portions being in heat exchange relationship with the coolant system. The metallic unit includes unitary cold plate and tower portions which respectively incorporate the cold plate and tower portions of the coolant system and fluid system. The dispenser unit also includes a coolant system, a fluid system and a metallic unit. The coolant system of the dispenser unit includes a dispenser inlet manifold and a dispenser outlet manifold. The coolant system of the dispenser unit further includes a plurality of coiled coolant lines. The fluid system is in heat exchange relationship with the coolant system, being disposed at least partially within the coiled coolant lines. The metallic unit of the dispenser unit incorporates the dispenser coolant system and fluid system.

72 Claims, 20 Drawing Sheets

APPARATUS FOR COOLING FLUIDS

This application is a continuation of application Ser. No. 08/615,399, filed Mar. 14, 1996, (Abandoned).

This is a continuation-in-part of U.S. Ser. No. 08/531,568, filed Sep. 13, 1995 now U.S. Pat. No. 5,743,107, which is incorporated herein by reference.

FIELD OF THE INVENTION

The present invention relates to an improved apparatus for dispensing cooled fluids, in particular beverages such as beer.

BACKGROUND OF THE INVENTION

In most commercial establishments where beer is served, the beer is supplied in barrels or kegs. Beer, as herein used, refers to anyone of those carbonated alcoholic malt beverages that are commonly called beer, ale and stout. The kegs of beer are stored and let to cool in refrigerated cold rooms that are provided in most commercial establishments to store foodstuffs and beverages for immediate access and use. For practical reasons, the temperature in cold rooms must be well above freezing (32° F.) and is typically sought to be maintained between 40° F. and 45° F. Accordingly, the beer, in kegs, stored in cold rooms is cooled to between 40° F. and 45° F. Under most favorable conditions, the beer is cooled to 40° F.

The beer that is chilled to 40° F. is dispensed from normally closed selectively operable beer-dispensing valves, or tap heads, that are located at serving stations that are remote from the cold rooms. The tap heads are normally carried at the upper ends of elongate vertically extending dispensing towers that are mounted atop and project upwardly from bar tops or counters so that the tap heads occur in spaced relationship above the counters and such that serving glasses and the like can be conveniently positioned on the counters, below the tap heads, to receive beer issuing from the tap heads.

The beer is delivered from the kegs to the tap heads through elongate beer delivery lines with upstream ends that are connected with taps that are engaged in the kegs. The beer lines extend from the kegs and from within the cold rooms and extend to the dispensing stations where their downstream ends are suitably connected with the tap heads.

The beer lines are most often established of ⅜"-ID plastic tubing that is especially formulated and approved for handling alcoholic beverages. The beer lines vary in length from about 15' or 20' to in excess of 100'. The downstream ends of the beer delivery lines connect with the upstream ends of equalizer or balance lines made of similar plastic tubing but which is smaller in inside diameter than the beer lines, For example, the balance lines are established of ¼"-ID tubing. The balance lines vary in length between 9' and 15'. Typically, the downstream ends of the balance lines connect with the upstream ends of ¼"-ID stainless steel connector tubes that project from the lower ends of the towers and that extend up through the towers and connect with the tap heads via tap fittings affixed in the upper ends of the towers.

In practice, beer is driven and caused to move from the kegs through the beer lines and to the tap heads by gas pressure. To this end, suitable high-pressure motive gas supplies are provided to introduce gas under desired pressure, into the kegs. The motive gases most commonly used are air, carbon dioxide, nitrogen, and combinations of those gases. The gases are most commonly provided in compressed gas cylinders that are stored in the cold rooms and are conducted from the cylinders into the kegs, to the taps, through gas lines. Pressure regulators are provided in the gas lines to control the pressure of the gas in the kegs. Due to friction losses in the systems, the pressure at which the gases are introduced into the kegs is adjusted and set so that beer dispensed from the tap heads flows at a set desired rate. The usual rate at which beer is dispensed from the tap heads is between 1 and 2 ounces per second.

When the gas ($CO_2$) that is entrained in beer is let to caused to separate from the beer, it creates foam composed of gas-filled bubbles of beer. When beer is dispensed into a serving glass, the foam generated by the escape of gas is seen to rise to the top of the beer. The foam is rather stable and is such that it breaks down at such a slow rate that it must often be directed to waste by letting it overflow and/or pouring it off from the glasses in which the beer is to be served. If beer is not properly handled, in excess of 50% of the beer can be lost to waste, in the form of foam.

The gas that is entrained in beer imparts into the beer that tongue- and palate-stimulating sensation that consumers of beer desire and that is sometime called its "life." As gas escapes from beer and is carried away in the form of foam, the beer loses its "life" and becomes what is referred to as "flat" and unpalatable, at a rapid rate. Thus, beer in a glass containing a large volume of foam is likely to have lost so much gas that it is flat and of inferior character, if not unmerchantable.

The gas in beer is quite unstable and is such that if let or caused to rapidly expand, as result of rapid thermal heating of the beer or as a result of a rapid reduction of pressure on the beer, it will immediately reach or attain a highly excited state in which adjacent expanding bubbles of beer displace the liquor of the beer and continue to establish ever-increasing larger bubbles of gas that cannot be contained by and that seek to escape or separate from the beer. Once the above gas-separating process starts and/or is put into motion, it does not stop immediately when the temperature and/or pressure on the beer becomes stabilized, but continues until the kinetic energy created by the process is spent and the beer returns to a suitable quiet state.

As the temperature of beer is lowered, the gas entrained therein contracts and becomes more stable and less likely to separate from the beer. Accordingly, it is desirable to chill beer to as low a temperature (above freezing) as possible when it is dispensed.

The above-noted gas-release process resulting from rapid rises in temperature and/or rapid drops in pressure will also occur at any temperature, though the severity of the process decreases as the temperature of the beer is decreased.

Furthermore, beer stored in kegs is maintained under pressure to maintain the gas compressed and entrained in the beer. When the pressure on the beer is suddenly released or reduced, as when the tap heads are opened, the gas entrained therein is let to expand and the above-noted gas-releasing process is set into motion. When the tap heads in beer-dispensing systems of the nature and character referred to above are opened, the pressure on the beer, immediately downstream from the tap heads, is released and the gas entrained in the beer commences to release. The foregoing results in the beer being driven or blasted through and out of the tap heads with and by the gas released immediately downstream thereof.

As a result of the foregoing, the prior art has resorted to the provision and use of the above-noted balance lines. The balance lines, which are smaller in inside diameter than the beer delivery lines, function to cause the drop in pressure that occurs when the tap heads are open to occur in the downstream end portions of the beer delivery lines. The balance lines are of sufficient length so that as the beer and free gas (that is released in the beer lines) enters the upstream ends thereof and continues to flow therethrough it becomes sufficiently quiet so that the freed gas is reabsorbed by the beer by the time the beer reaches and flows through and from the tap heads. While the noted balance lines are effective to eliminate or greatly reduce those adverse effects that result from a rapid release of pressure on beer, they have little or no effect in preventing the adverse effects that result from progressive warming of the beer and expansion of the gas contained therein.

As a result of the foregoing, while the provision and use of the above-noted balance lines attains beneficial end results, they are not wholly effective to prevent the escape of gas from beer flowing therethrough and the generating of excess foam that is discharged through and from the tap heads with the beer that is dispensed. Foam typically accounts for as much as 25% of the total volume of beer dispensed by means of presently known dispensing systems. This represents a significant loss of product.

The portions of the beer lines that extend from the cold rooms to the dispensing stations and the balance lines, connecting tubes and tap heads are exposed to the ambient temperatures of the establishments in which the beer-dispensing systems are installed. Accordingly, though the beer might be cooled to 40° F. when it enters the beer lines, it will (if not maintained cooled) warm and heat to temperatures beyond which the beer can be satisfactorily dispensed. To this end, the prior art has resorted to the provision and use of what the art refers to as "glycol machines or systems" that serve to prevent excess warming of beer as it flows through beer-dispensing systems.

The above-referred to glycol systems typically include refrigerated glycol heat exchanger units and in which a glycol (anti-freeze) solution is chilled. The systems next include an elongate glycol delivery lines with an upstream end that connects with the heat exchanger unit and that extend longitudinally of the beer lines in heat-conducting contact therewith; and a glycol return line continuing from the downstream ends of the glycol delivery line and that extend longitudinally of the beer lines, in heat-conducting contact therewith and that has a downstream end that connects with the heat exchanger unit. Pump means are included to cause the glycol solution to continuously recirculate through the glycol lines and the heat exchange unit. The related beer lines and glycol lines are contained within an elongate thermal-insulating jacket structure. The assembled beer and glycol lines and the thermal-insulating jacket establish what is commonly referred to as a "trunk line."

In practice, the glycol delivery and return lines are commonly extended to run parallel with and adjacent to the balance lines.

The glycol lines are established of the same plastic tubing as the beer delivery lines and balance lines.

While the above-noted glycol systems would appear to establish good and effective heat exchanger means that would work to prevent warming of beer flowing through the beer lines and balance lines, they do not prevent warming of the beer but simply slow the rate at which the beer warms as it flows from the kegs to the tap heads. This is due to the fact that the plastic tubing of which the several lines are established has an extremely low coefficient of heat conductivity. Further, while the glycol lines are in contact with the beer-conducting lines, that contact seldom amounts to more than thin line contact. Further, due to space limitations and the like, the thermal-insulating jackets used in trunk lines are not so efficient a barrier of heat to prevent more heat from entering the trunk lines and reaching the beer delivery lines than can be carried away by the glycol flowing through the glycol lines.

As a result of the foregoing, when, for example, glycol chilled to 25° F. is conducted through 200' of glycol line in a 100' long trunk line and beer, at 40° F., is conducted through a related 100' of beer line within that trunk line, the temperature of the glycol, as it is returned to the glycol heat exchanger, is likely to be warmed to 27° F. or 28° F. and the beer, at the downstream end of the beer line is likely to be warmed to an excess of 45° F. Accordingly, the noted glycol systems work to notably slow the rate at which beer warms as it flows through related beer lines, it does not chill the beer and does not prevent warming of the beer. That warming of the beer that does take place and results in expansion of the gas entrained in that beer to render the gas highly unstable and very likely to commence to separate from the beer.

The above-noted warming of beer as it moves through the noted trunk lines is accelerated somewhat as it advances through related balance lines to tap heads. This further destabilizes the gas in the beer and renders it such that when the tap heads are opened, and the pressure on the beer is released, gas commences to escape from the beer, generating foam which is dispensed from the tap heads together with that beer which is not foamed.

The prior art has resorted to the provision and use of high efficiency heat exchangers connected with and between the downstream ends of the beer delivery lines and the upstream ends of related balance lines and through which chilled glycol is conducted to chill and reduce the temperature of the beer from, for example, 40° F. to 30° F. The beer chilled to 30° F. is then conducted into and through the balance lines and thence through and from the tap heads. When chilled to 30° F. as noted above, the gas in the beer is considerably more stable than it was when the beer was 40° F. However, the beer is allowed to warm two or three degrees as it advances through the balance lines. The gas expands accordingly, resulting in gas escape and foam generation. The amount of foam that is generated under such circumstances is denser or less in volume and is colder, but it is nonetheless generated.

The most effective and efficient heat exchangers referred to in the foregoing are cold plate type heat exchangers that include cast aluminum bodies with stainless steel beer- and glycol-conducting coils therein that are suitably connected with the beer and balance lines and with the glycol delivery and return lines. The aluminum bodies are suitably jacketed with thermal insulation to block the entry of ambient heat (72° F.) into the bodies.

Other chilling means for lowering the temperature of beer before it is conducted into and through balance lines in beer-dispensing systems have included common refrigerated bath-type chillers. Those heat exchangers have proven to be notably less efficient and effective than the above-noted cold plate type heat exchangers.

In another beer-dispensing system provided by the prior art, the balance lines are established of stainless steel and are arranged within compartments or chambers within related dispensing tower structures mounted atop counters and that carry the tap heads. The chilled glycol of related glycol systems is circulated in and through the chamber and about the balance lines to chill the beer within and flowing through the balance lines to the tap heads. While this form of heat exchange means is effective to chill beer that is let to stand in the balance lines, the glycol is incapable of carrying off heat from the beer (through the walls of the balance lines) at a sufficient rate to notably chill beer that is continuously flowing through the balance lines at a rate of, for example, 4 ounces per second. As a result of the above, the first-to-be-served beer (that has been let to stand and to chill in the balance lines) is suitably chilled. Thereafter, as the chilled beer is dispensed and new and warm beer enters the balance lines to replace it, the temperature of the beer being dispensed warms at a notable rate and the dispensing of the beer must be delayed after each serving of beer has been dispensed, if beer, at the desired low temperature, is to be served.

In addition to the above, when warm beer enters the balance lines in the lastnoted heat exchanger means and combines with previously chilled beer in the balance lines, a portion of the chilled beer is warmed by the incoming beer. When that chilled beer is thus warmed, the gas therein expands and the previously noted gas release process takes place. As a result of the foregoing, when beer is dispensed from systems including the last-noted form of heat exchanger means, the beer dispensed is seldom uniform, that is, it intermittently runs clear and free of foam and then runs laded with foam for short periods of time.

The foregoing problems are also attendant to a greater or lesser extent in connection with dispensing other beverages, such as wine, soft drinks, fruit juices, etc., as well as generally with dispensing any type of fluid which is desired to be chilled.

Additional problems arise in situations in which very large quantities of beverages must be dispensed, and in situations in which it is impossible or impractical to store beverages in volume, such as kegs of beer, in a low-temperature environment prior to dispensing the beverage. In the latter situation, it is sometimes the case that kegs of beer or other bulk beverages are stored at ambient temperature rather than in a cold room. In either event, additional beverage cooling capacity is needed to cool the beverage to a commercially desirable dispensing temperature.

A need exists for an improved apparatus for dispensing cooled fluids, in particular beverages such as beers, soft drinks, etc., which is capable of dispensing the cooled fluid at a rapid rate without the need for pausing between portions.

A need also exists for an improved apparatus for dispensing cooled carbonated beverages which is capable of reducing or substantially eliminating foam formation in the dispensed beverages.

A need also exists for an improved apparatus for dispensing cooled liquids which includes separable components that can be separately manufactured and installed.

There is also a need for an apparatus that can be mounted entirely on a surface such as a countertop.

There is a further need for an apparatus that is capable of delivering very high volumes of cooled liquids.

A need also exists for an apparatus that is capable of dispensing liquids that are supplied to the apparatus at ambient temperatures.

SUMMARY OF THE PREFERRED EMBODIMENTS

In accordance with one aspect of the present invention, there is provided a cold plate unit that includes a coolant system, a fluid system and a metallic unit. The coolant system includes a primary inlet manifold, a secondary inlet manifold, a secondary outlet manifold and a primary outlet manifold, and further includes a first plurality of coolant line segments connecting the primary inlet manifold and the secondary inlet manifold and a second plurality of coolant line segments connecting the secondary outlet manifold and the primary outlet manifold. The fluid system is in heat exchange relationship with the coolant system. The metallic unit incorporates the coolant system and the fluid system.

In a preferred embodiment of the cold plate unit, the coolant system defines a cold plate portion and a tower portion, the cold plate portion including the primary inlet manifold and the primary outlet manifold and the tower portion including the secondary inlet manifold and the secondary outlet manifold. The fluid system defines a cold plate portion and a tower portion, the portions being in heat exchange relationship with the coolant system. The metallic unit includes unitary cold plate and tower portions which respectively incorporate the cold plate and tower portions of the coolant and fluid systems.

In accordance with another aspect of the present invention, there is provided a dispenser unit which also includes coolant and fluid systems and a metallic unit. The coolant system includes a dispenser inlet manifold and a dispenser outlet manifold, and further includes a plurality of coiled coolant lines. The fluid system is in heat exchange relationship with the coolant system, and is disposed at least partially within the coiled coolant lines. The metallic unit incorporates the coolant and fluid systems.

The dispenser unit can be employed by itself as a complete liquid cooling device, or can be used together with one or more additional cold plate units of the invention to form a multi-unit system. The dispenser unit can have any desired orientation (i.e., vertical, horizontal, inclined) and any desired shape, including a cube, a rectangular prism, a cylinder, etc. The coiled coolant and fluid lines can be formed as square or rectangular coils, circular coils, or any other desired configuration.

Preferably, the fluid system includes at least one restricter segment. In another preferred embodiment, the fluid system includes a plurality of fluid lines each at least partially disposed within the coiled coolant lines. At least one of the fluid lines preferably includes a restricter segment.

In accordance with a further aspect of the present invention, there is provided an apparatus for cooling a fluid which includes a cold plate unit and a dispenser unit as described above. Preferably, the cold plate and dispenser units further include fittings adapted to enable the engagement of the respective coolant and fluid systems of the two units.

In accordance with yet another aspect of the present invention, there is provided a cold plate unit that includes a coolant system and a fluid system in heat exchange relationship, and a metallic unit. The coolant system has primary inlet and outlet manifolds and a plurality of coolant lines each including a plurality of loops. The fluid system includes at least one fluid line preferably also including a plurality of loops, and preferably is interleaved with the coolant lines. The metallic unit incorporates the coolant and fluid systems.

In preferred embodiments, the foregoing cold plate is employed together with a dispenser unit as described herein, or with an apparatus for cooling a fluid as described herein. The latter embodiment is of particular advantage when used to dispense fluids that are initially supplied at ambient temperature, or to dispense large volumes of cooled fluids. The cold plate acts as a pre-chiller to cool the liquid to a temperature between ambient and the desired dispensing temperature, while the dispenser unit or the apparatus further complete the cooling of the fluid to the desired dispensing temperature.

The inventive apparatus is capable of dispensing any fluid, particularly any beverage, at a desired service temperature, preferably at a temperature below 32° F., with substantially no foam formation, particularly in beers. Use of the inventive apparatus thus reduces product loss and enhances revenue to the beverage vendor. Soft drinks can be dispensed without the need for ice cooling, as is typically the case with known soft drink dispensing systems.

Another advantage of the present invention is that cooling of the fluids occurs immediately before the point at which the fluids are dispensed, rather than at an intermediate location from which the fluids must subsequently be transferred. Thus, potential reheating of cooled fluids is avoided.

The cold temperatures afforded by the present invention also help reduce yeast activity and growth, which reduces the service requirements for beer dispensing. That is, beer lines according to the invention require less frequent cleaning due to the reduced yeast growth, typically every 3–4 weeks rather than every week as is presently the case with known beer dispensing apparatus. This represents a significant saving in cleaning expense and down time.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which

FIG. 14*a* illustrates the coil basket, while FIG. 14*b* shows a complete unit including metallic unit, insulation, covering and tap heads.

In the figures, like elements are labeled alike throughout.

DETAILED DESCRIPTION OF THE PREFERRED EMBODIMENTS

Figure 1:
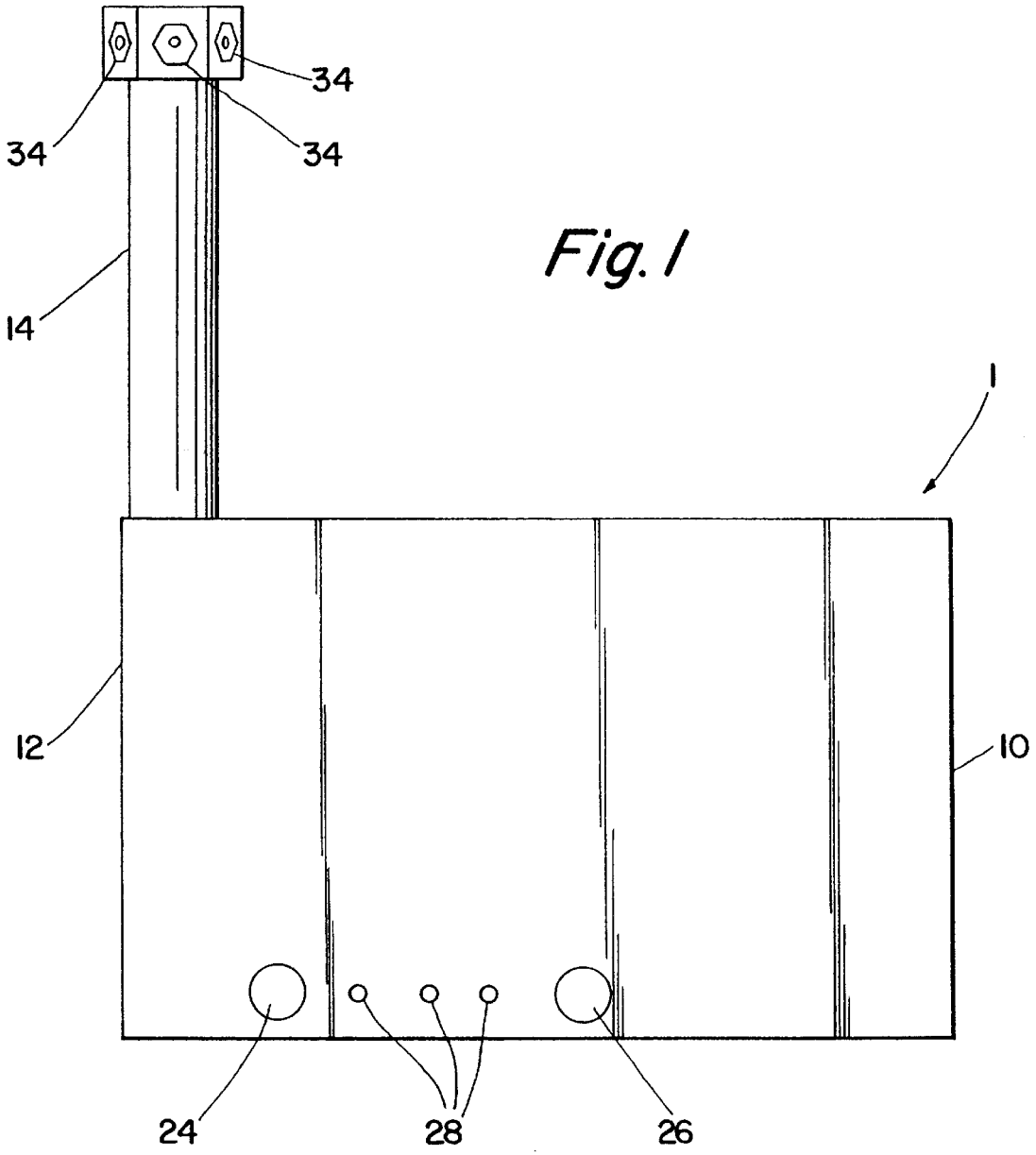
FIGS. 1–2 are front and right side elevational views, respectively, of an embodiment of the metallic unit of an apparatus according to the invention showing the unitary tower and cold plate portions and the positions of the coolant primary inlet and outlet manifolds, fluid line inlets and tap fittings.
Figure 2:
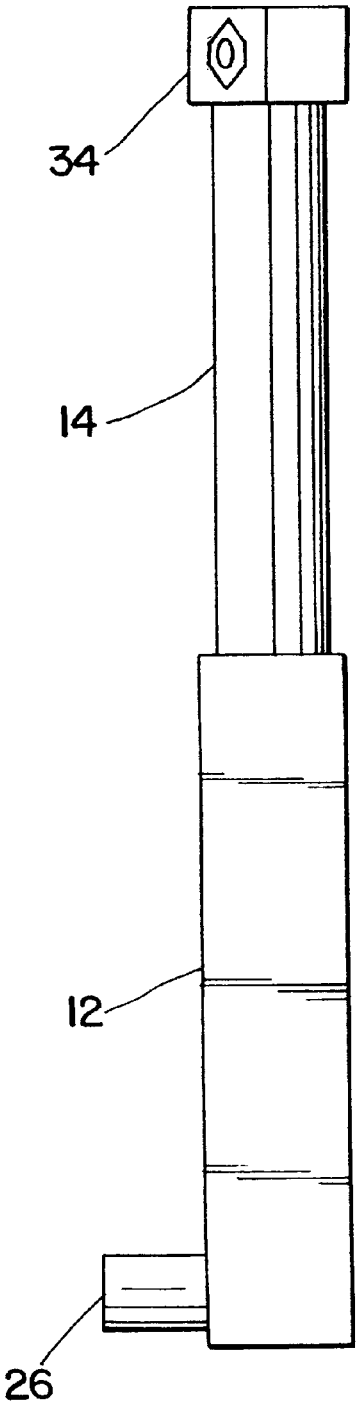

With reference to FIGS. 1 and 2, an embodiment 1 of a fluid cooling apparatus of the invention (hereinafter an "integral unit") includes a metallic unit 10 comprising cold plate portion 12 and tower portion 14 which is formed integrally with cold plate portion 12 by casting, as described in detail below. Cold plate portion 12 preferably has the shape of a flat, rectangular plate. Tower portion 14 preferably has the shape of a cylinder. Other shapes can also be employed if desired.

Figure 3:
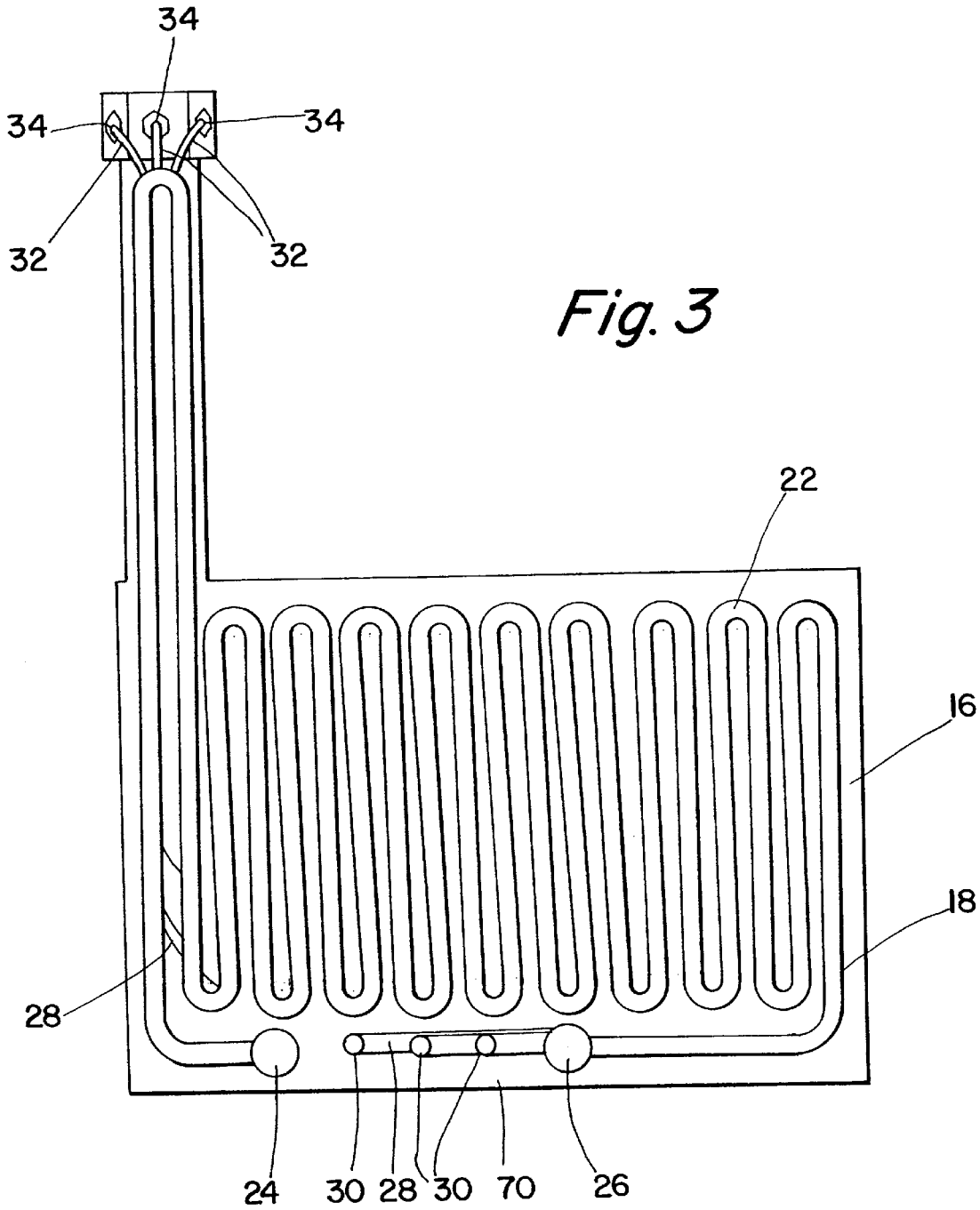
FIG. 3 is a front cutaway view of the embodiment of FIG. 1 showing the positioning of a coil basket including the coolant and fluid lines within the metallic unit.

Disposed within metallic unit 10, as shown in FIG. 3, is coil basket 16. Coil basket 16 includes coolant system 18 and fluid system 20. Coolant system 18 comprises a plurality of coolant lines 22 extending between primary inlet manifold 24 and primary outlet manifold 26. Fluid system 20 comprises at least one fluid line 28, preferably a plurality of fluid lines 28.

Each fluid line 28 has fluid inlet 30 and outlet end 32 which is affixed to a tap fitting 34. The coolant lines 22 and at least one fluid line 28 are arranged in heat exchange relationship. By "heat exchange relationship" is denoted a spatial configuration such that heat can flow between at least one fluid line and at least one coolant line. Preferably, the fluid line(s) and coolant lines are arranged in countercurrent flow relationship.

Figure 4:
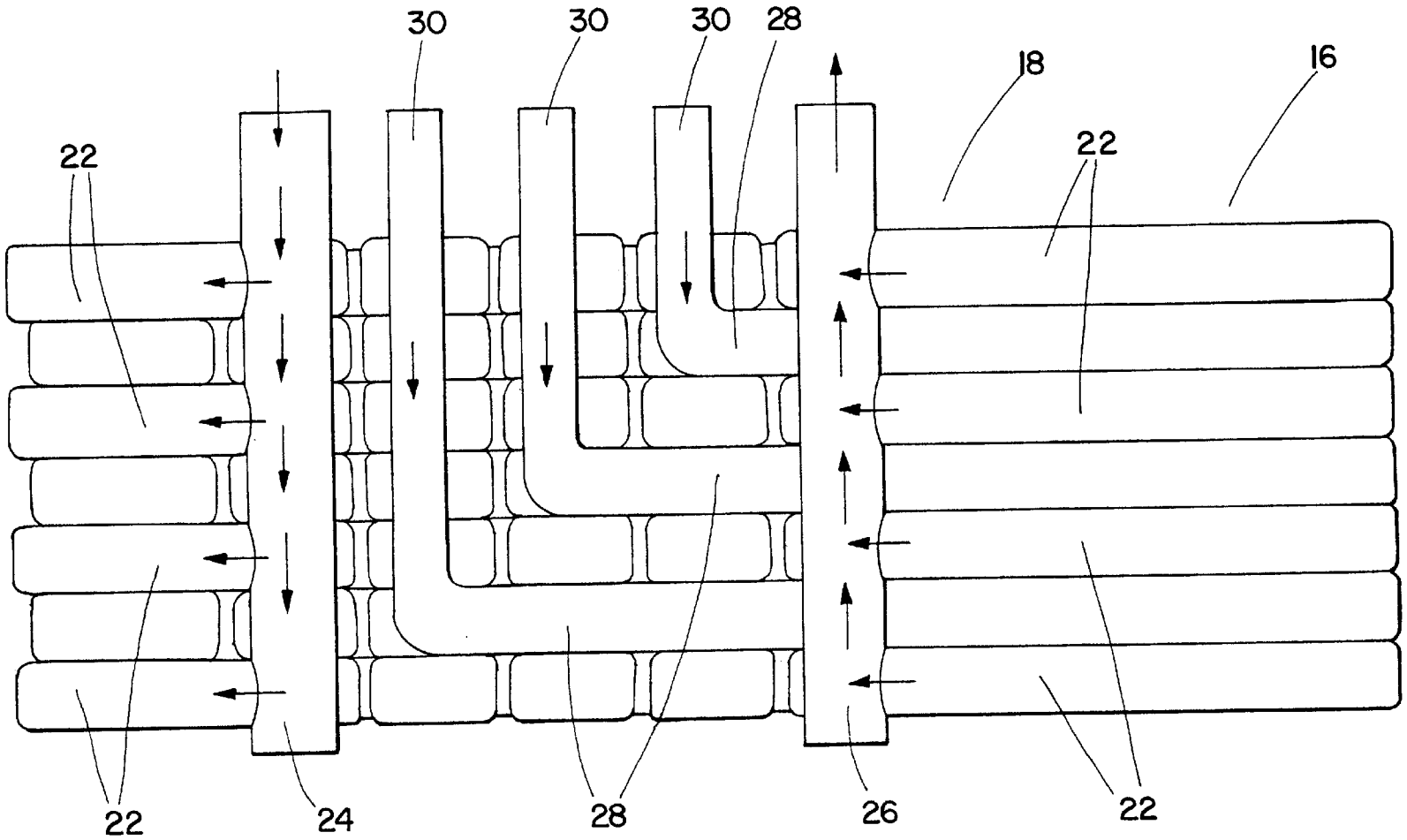
FIGS. 4–5 are a bottom plan view and a left profile view, respectively, of the coil basket including the coolant and fluid systems of the embodiment of FIG. 1. Flows are shown by arrows.
Figure 5:
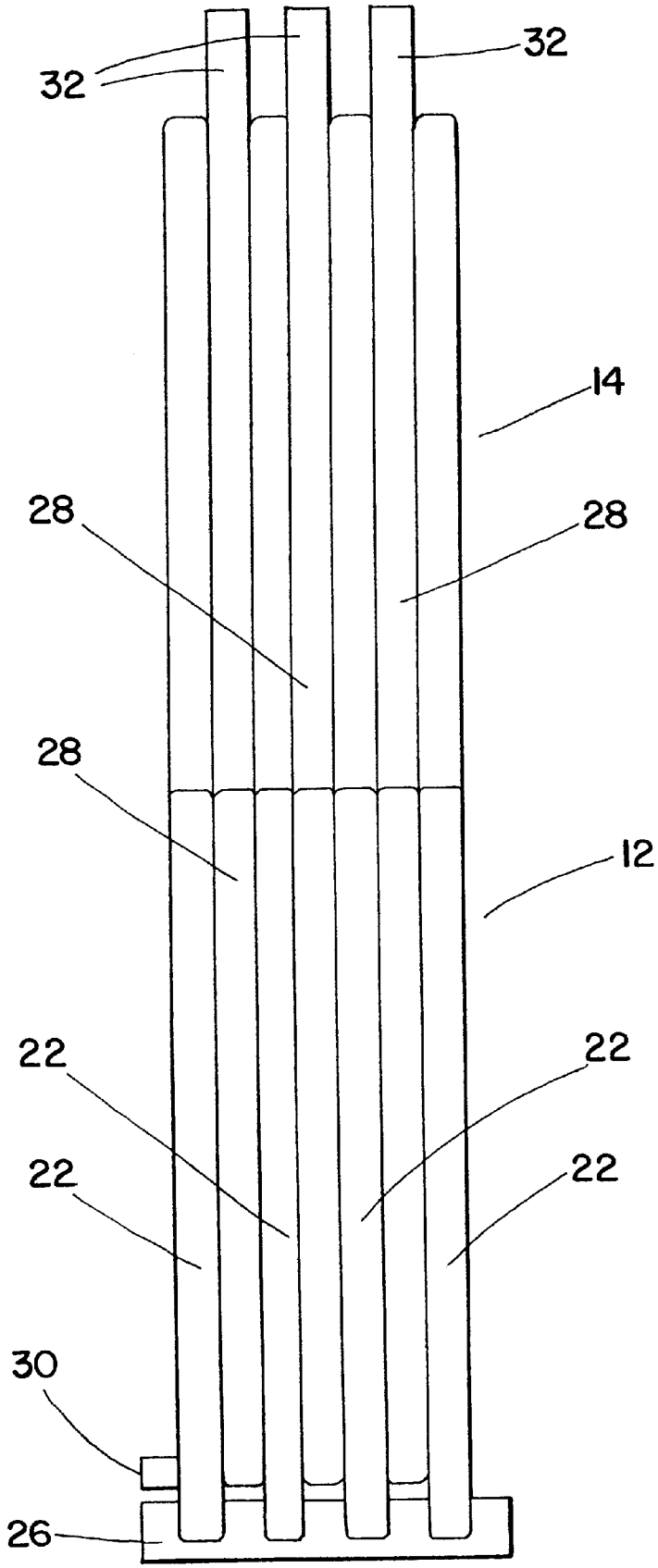

Preferably, the fluid lines 28 are interleaved between the coolant lines 22 as shown in FIGS. 4–5. The number of coolant lines thus preferably is at least one greater than the number of fluid lines. For example, when the fluid system includes three fluid lines, the coolant system preferably includes four coolant lines, and the lines are arranged in an alternating manner such that each fluid line is disposed between two coolant lines.

The coolant system 18 defines a cold plate portion 36 and a tower portion 38 which are disposed within corresponding cold plate portion 12 and tower portion 14 of metallic unit 12, respectively. Tower portion 38 is defined by a portion of at least one coolant line 22, preferably by corresponding portions of at least two coolant lines 22. Tower portion 38 comprises upper portion 40 of tower coolant loop 42 of coolant line 22. Tower coolant loop 42 is connected at inlet end 44 to primary inlet manifold 24 and includes a short horizontal section 25 which turns at bend 27 and extends vertically to tower bend 46 and subsequently downward to cold plate end 48.

At cold plate end 48, tower coolant loop 42 merges with a first of a plurality of cold plate coolant loops 50 of coolant line 22. The number of coolant loops typically ranges from 5 to 20. In the preferred embodiment of FIG. 6, 9 coolant loops are employed. Together with lower portion 52 of tower coolant loop 42, cold plate coolant loops 50 partially define cold plate portion 36 of coolant system 18.

In embodiments in which one or more coolant lines 22 do not include tower coolant loops 42 (i.e., do not serve to partially define tower portion 38), such coolant lines include only a plurality of cold plate coolant loops 50 connected at respective inlet ends 44 to primary inlet manifold 24. Such lines include one more cold plate coolant loop 50 than the coolant lines which partially define tower portion 38, the additional cold plate coolant loop 50 corresponding to tower coolant loop(s) 42.

Preferably, from one to four coolant lines 22 include tower coolant loops 42. The number of tower coolant loops 42 is determined by the cooling requirements of tower portion 14. An excessive number of tower coolant loops 42 may cause the tower portion 14 to freeze.

The plurality of cold plate coolant loops 50 in each coolant line 22 include outlet bend 51 leading to horizontal outlet section 52 with outlet end 54 which is connected to primary outlet manifold 26.

Figure 6:
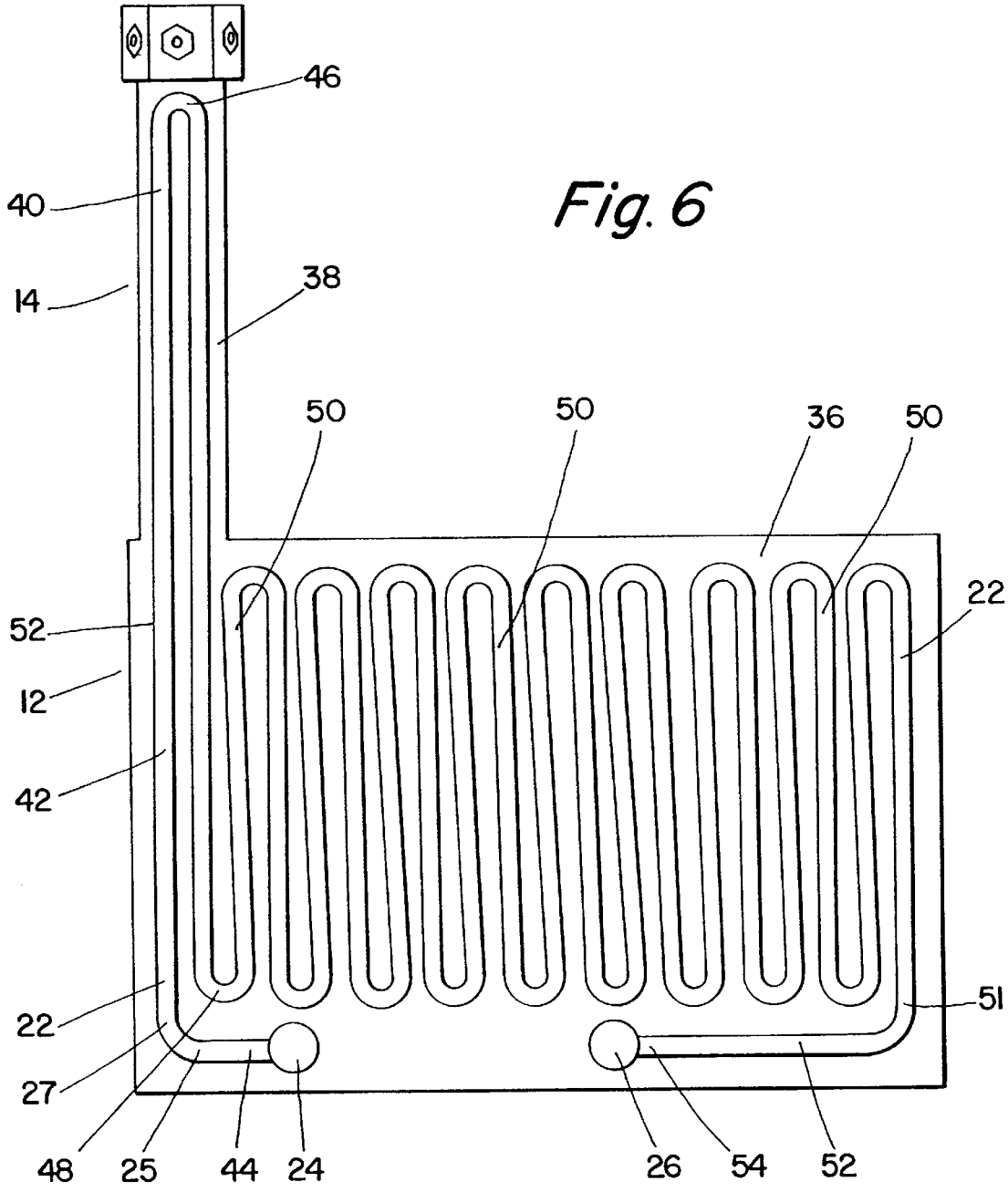
FIG. 6 is a front cutaway view of a coolant line of FIG. 1 in isolation, showing its disposition within the metallic unit.

In a preferred embodiment of coolant system 18 illustrated in FIG. 6, each coolant line 22 includes horizontal inlet section 25 and horizontal outlet section 52 connected to the primary inlet and outlet manifolds, respectively. If desired, coolant lines 22 can be configured to extend vertically from primary inlet manifold 24 and to primary outlet manifold 26, i.e., to omit the horizontal inlet and outlet sections.

The primary inlet and outlet manifolds 24 and 26 are sized such that an adequate flow of coolant, such as chilled glycol, can flow through the coolant system 18. Preferably, the primary inlet and outlet manifolds have diameters ranging from about 0.5 to 1 inch, particularly about 0.5 inch. Typical manifold lengths range from about 3 to 5 inches. The lengths of the primary inlet and outlet manifolds are determined according to routine design factors such as the thickness of the coil basket 16 employed, the desired thickness of the cold plate portion 12 of the metallic unit, etc. The cooling lines 22 preferably have diameters ranging from about 0.25 to 0.5 inch, more preferably about 0.3125 inch (5/16 inch). The number of coolant lines 22 employed will vary depending on design choices such as the thickness of the cold plate portion 12, which in turn is influenced by the types and quantities of fluids, such as beer or other beverages, which it is desired to cool. The thicker the plate, the greater the quantity of fluid that can be cooled. Thicker plates also allow cooling of multiple different types of fluids, such as beer, wine and/or other carbonated beverages such as soft drinks, at the same time. The number of coolant lines will typically vary between 2 and 12, more preferably 2 and 8, and typically 3–4.

The coolant lines 22 and primary inlet and outlet manifolds 24 and 26 preferably are formed from stainless steel, such as "304" (commercially available from Oakley Tubing, Denver, Colo.). Stainless steel is particularly preferred because it is capable of withstanding contact with molten metal, such as molten aluminum or aluminum alloys, which are preferably used to form the metallic unit according to the invention (as described below), without melting, deforming or reacting with the molten metal. Other metals which are similarly resistant, e.g., tungsten, titanium, noble metals, etc., can also be used if desired to form the coolant lines and manifolds.

The coolant lines 22 preferably are connected to the primary inlet and outlet manifolds 24 and 26 by welding. Welding is preferred in other to minimize the occurrence of leakage within the cold plate portion 12 at the joints between coolant system components.

The bend radius of each coolant loop, and the spacing thereof, are matters of routine design choice depending of factors such as the desired size and shape of the cold plate portion, the type of tube bending equipment and the tube bending process employed, etc. In a preferred embodiment using 5/16 inch tubing for the coolant lines 22 and 9 coolant loops, a bend radius of about 0.531 inch is beneficial.

In forming the bends in the coolant lines 22, it is preferred to form coolant loops 50 that bend by 180°, i.e., that have parallel legs. Subsequently, the coolant lines 22 can be compressed laterally to reduce the spacing between adjacent loops, as shown in FIG. 6. Alternatively, the coolant lines 22 can be left uncompressed, i.e, with all legs parallel to each other.

In a preferred embodiment, fluid system 20 includes one or more, preferably at least two, fluid lines 28. The fluid lines 28 are not manifolded, in contrast to the coolant lines 22, but preferably are interleaved between coolant lines 22 in an alternating manner as discussed above and as shown in FIG. 4. This permits the simultaneous cooling of a plurality of different fluids simultaneously, each fluid flowing through a different fluid line 28. Alternatively, the quantity of a single fluid to be cooled can be increased by the use of multiple separate fluid lines 28.

The fluid system 20 defines a cold plate portion 54 and an end segment 56. Cold plate portion 54 includes fluid inlet segment 58 within which fluid inlet 30 is defined. Preferably, fluid inlets 30 are adjacent coolant primary outlet manifold 26 (i.e., fluid system 20 and coolant system 18 are in a countercurrent flow relationship). Fluid inlet segment 58 in turn joins with a plurality of cold plate fluid loops 60. Preferably, the number, spacing and configuration of cold plate fluid loops 60 correspond to those of cold plate coolant loops 50, i.e., the shapes of the coolant and fluid lines are similar. Such a configuration enhances heat transfer between the fluid and coolant lines.

Figure 9A:
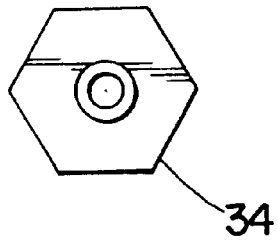
FIGS. 9*a–c* are back, front and side views of a preferred tap fitting employed in the embodiment of FIG. 1.
Figure 9B:
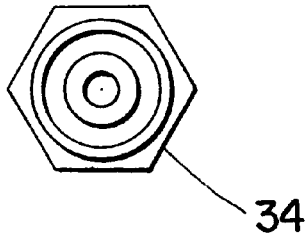
Figure 9C:
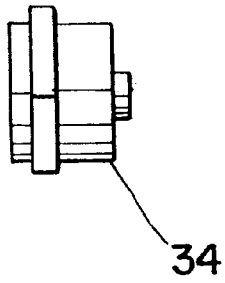
Figure 7:
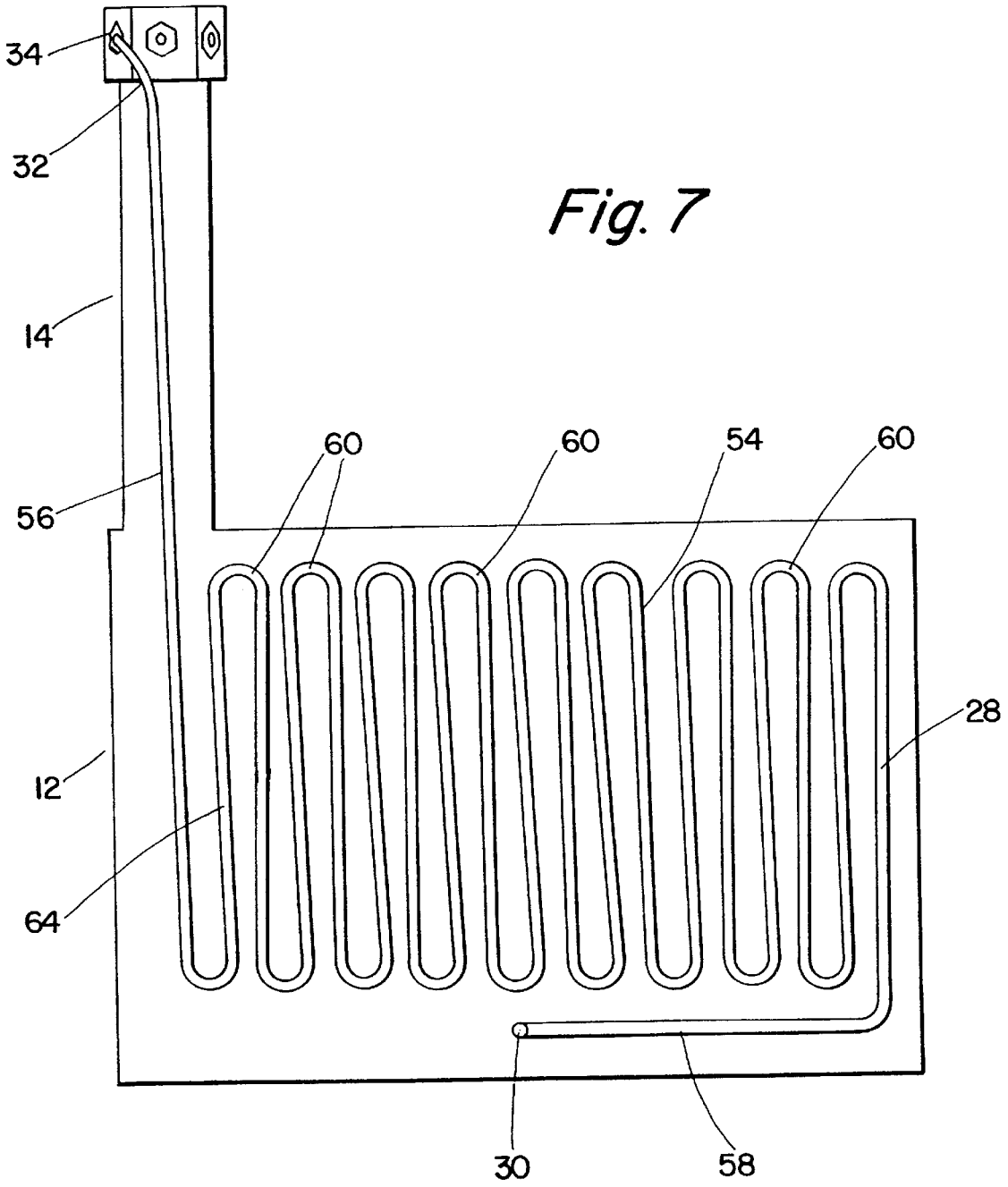
FIG. 7 is a front cutaway view of a fluid line of FIG. 1 in isolation, showing its disposition within the metallic unit and its connection to the tap fitting in the tower portion of the metallic unit.

The last of said plurality of cold plate fluid loops 60 in turn joins with end segment 56. End segment 56 extends vertically through cold plate portion 12 of metallic unit 10 and connects at outlet end 32 to means for dispensing a fluid from fluid line 28 as shown in FIG. 7. In a preferred embodiment, outlet end 32 is connected to tap fitting 34, illustrated in FIGS. 9*a–c*. Preferably, outlet end 32 is welded to tap fitting 34.

End segment 56 preferably extends between tower coolant loops 42. Multiple end segments 56 of fluid lines 28 can extend between a smaller number of tower coolant loops 42. For example, three end segments 56 of separate fluid lines 28 can extend between two tower coolant loops 42 of coolant lines 22, with additional coolant lines 22 omitting tower coolant loops as discussed above.

Fluid lines 28 preferably have diameters ranging from 0.25 to 0.5 inch, particularly 5/16 inch. In a preferred embodiment, a fitting, such as a barb fitting, is welded to fluid lines 28 at fluid inlets 30. Typical, ¼ inch to ¾ inch barb fittings are employed. For a 5/16 inch line, a ⅜ inch barb fitting is benefically employed. Similar barb fittings can be employed with the coolant primary inlet and outlet manifolds. The use of such fittings is well known in the art, and is illustrated, for example, in U.S. patent application Ser. No. 08/394,910, now U.S. Pat. No. 5,564,602, which is incorporated herein in its entirety by reference. External coolant and fluid lines can easily be connected to the inventive apparatus by means of such barbed fittings, as is well known to those skilled in the art.

An exemplary embodiment of the inventive apparatus includes a coolant system having ½ inch primary inlet and outlet manifolds with ½ inch barb fittings. Three coolant lines of 5/16 inch diameter extend between the primary inlet and outlet manifolds. Two fluid lines of 5/16 inch diameter, with ⅜ inch barb fittings, are interleaved between the coolant lines.

In a preferred embodiment, fluid lines 28 include restricter segments 64. Restricter segments 64 preferably comprise end segments 56, and preferably also include portions of at least one cold plate fluid loop 60, as shown by the dotted line in FIG. 7. Restricter segment 64 has a diameter smaller than the diameter of the remainder of fluid line 28, and preferably is affixed to the remainder of fluid line 28 by welding. Diameter reduction is typically about 1/16 inch. Selection of the diameter of the restricter section is a matter of routine design choice. A preferred length for the restricter segment is between about 7 and 9 feet. The reduction in line diameter serves to compress the fluid flowing through fluid line 28. Restricter segment 64 thus affords additional foam reduction in carbonated beverages, particularly beers, which are dispensed from the inventive apparatus.

Metallic unit 10 preferably is comprised of aluminum or an aluminum alloy. Typical useful aluminum alloys include 99.7% Al (P-10/20), as well as A356 or the like. Other metals, such as copper lead, or brass, could also be used, but such metals must be compatible with the materials used to form the coolant and fluid systems, and preferably have thermal conductivities similar to that of aluminum.

The metallic unit 10 is preferably formed by a standard "permanent molding" casting process. In an exemplary process, aluminum or a selected aluminum alloy is smelted in a smelting furnace. Meanwhile, a preassembled coil basket 16 is placed in a mold having the desired shape of the metallic unit. Preferably, tap fittings 34 are connected to the outlet ends 32 of the fluid lines 28 of coil basket 16 prior to placement of the coil basket into the mold. Incorporating the tap fittings 34 directly into the top of the tower portion of the metallic unit has the advantage of maintaining the chilled fluid at the desired temperature until it enters the tap heads to be dispensed. Furthermore, when tap heads are connected to the incorporated tap fittings, condensation occurs on the tap heads at and near the point of connection, conferring an attractive appearance to the tap heads.

The mold is clamped shut, and the aluminum or alloy is ladled out from the smelting furnace into the mold. The casting temperature is approximately 1400° F. Once cast, the aluminum solidifies around the coil basket 16.

The solidified metallic body 10 is subsequently removed from the mold, excess aluminum is removed and recovered for recycling, and the metallic unit is cooled to ambient temperature. Finally, the metallic unit 10 is pressure tested for leaks, and passivated to de-scale deposits, particularly iron oxide, from the interior of the coolant and fluid lines, using a standard process such as flowing a nitric/phosphoric acid mixture through the coolant and fluid lines. The unit is then ready for installation, as discussed below.

Figure 8:
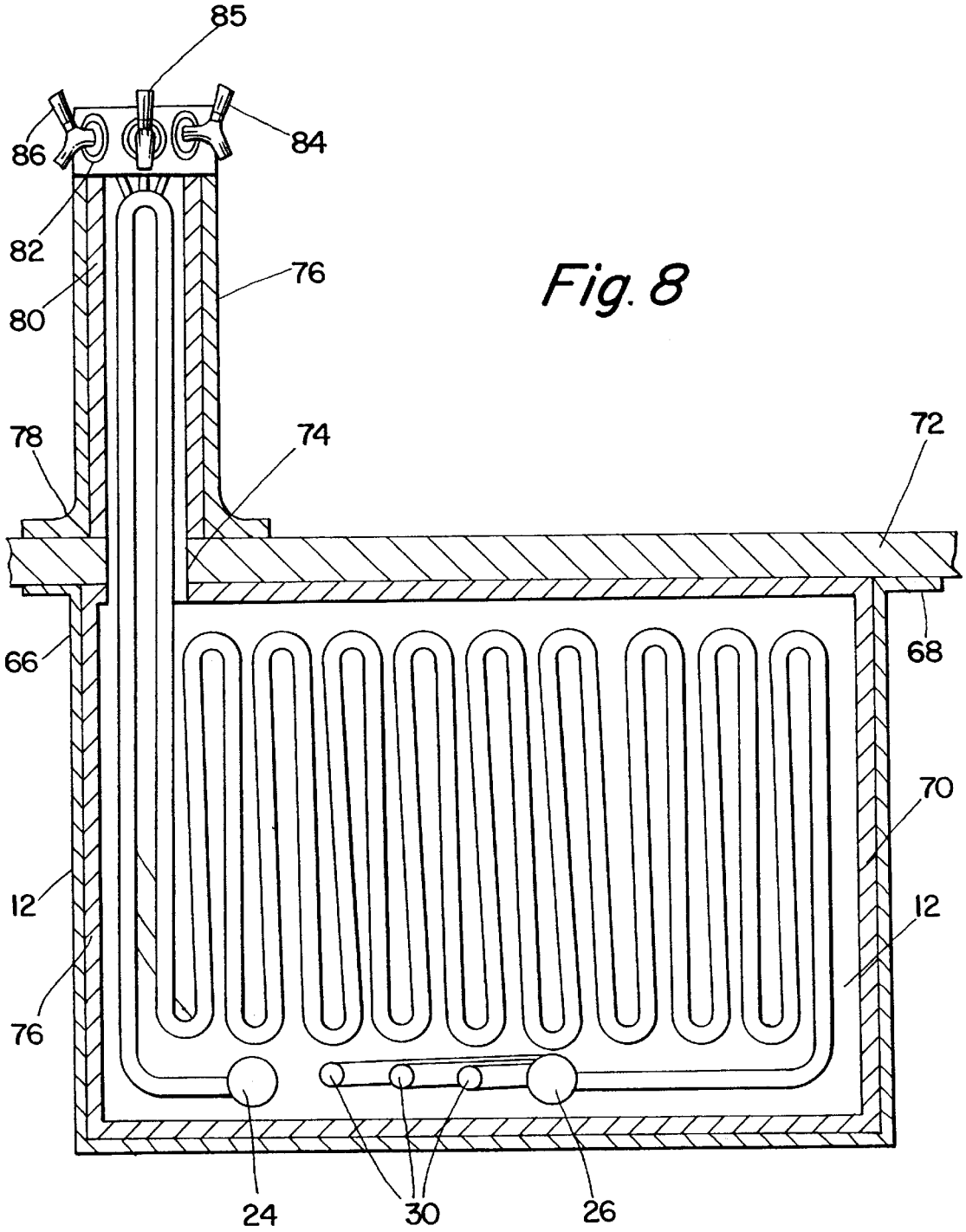
FIG. 8 is a front cutaway view of an embodiment of the invention including the metallic unit of FIG. 1 disposed within and through in a surface such as a countertop, in which the cold plate portion of the metallic unit is insulated and encased within a flanged casing, the tower unit is insulated and encased within a tower shield, and tap heads are affixed to the fittings.

FIG. 8 illustrates an apparatus of the invention installed in a bar, counter top or other surface. Cold plate portion 12 of metallic unit 10 of the apparatus is disposed within shell 66 having flange 68. Cold plate portion 12 can optionally be wrapped with an insulating reflective material as is known in the art. Between cold plate portion 12 and shell 66 is a layer of insulation 70. Preferably, the layer of insulation 70 is formed by injecting or pouring a liquid material into the space between cold plate portion 12 and shell 66 and hardening the liquid material to form a foam insulating material. Other types of insulation, such as sheets of foam material (e.g., urethane foam) can be inserted between cold plate portion 12 and shell 66 if desired. Injection of a liquid material is preferred because is affords a uniform and uninterrupted body of insulation that effectively prevents the condensation and accumulation of moisture within the structure that might otherwise adversely affect its thermal-insulating characteristics and result in premature degradation of the structure, as often occurs when other kinds of insulating materials are used.

Cold plate portion 12 is secured in place by affixing flange 68 to the underside of bar countertop 72, for example by bolts.

Tower portion 14 of metallic body 10 projects through an opening 74 in bar countertop 72. Tower portion 14 optionally is also wrapped with an insulating, reflective material, and a tower sheath 76 is disposed around tower portion 14 and affixed to the upper side of bar countertop 72, by screws, bolts or other conventional means, for example via integral collar 78. The space between tower portion 14 and tower sheath 76 preferably is also filled with a layer of insulation 80 similar and formed similarly to layer 70. Tower sheath 76 has defined at its top end a plurality of openings 82 which correspond to tap fittings 34 in tower portion 14. These openings 80 are aligned with the tap fittings 34, and tap heads 84 are connected to tap fittings 34. Tower sheath 76 is closed by cap 86.

With FIG. 8 in view, a preferred procedure for preparing and installing an apparatus of the present invention in a desired setting, such as a counter or bar, includes the following steps. The cold plate portion of the metallic unit optionally is first wrapped with an insulating, reflective material. The wrapped cold plate portion is next placed within a shell, preferably a flanged shell as described herein. A foam insulation material is then injected into the space between the wrapped cold plate portion and the shell, and the insulation is hardened. If desired the shell can be removed. Preferably, however, the shell is retained about the insulated cold plate portion of the metallic unit.

The partially insulated metallic unit is then mounted by extending the tower portion of the metallic unit through an opening which has been defined through the counter, bar or other surface. The insulated cold plate portion is affixed beneath the surface. If the shell, preferably the flanged shell, has been retained, the insulated cold plate portion can be affixed to the underside of the surface via the flange. The protruding tower portion of the metallic unit optionally is first wrapped with an insulating, reflective material as described above with respect to the cold plate portion. A tower sheath is then disposed about the tower portion and affixed to the upper side of the counter, bar or other surface. Next, tap heads are installed in the various tap fittings in the top of the tower portion through aligned openings in the tower sheath. Foam insulation is injected into the space between the tower sheath and the tower portion and hardened. Finally, the tower portion is capped.

To operate the inventive apparatus, a source of coolant, such as a conventional glycol chilling unit, is connected to the primary inlet and outlet manifolds of the coolant system of the apparatus. Sources of fluids to be chilled, preferably beverages such as beer, wine or soft drinks which are pre-chilled, e.g., to a temperature of about 45° F., are connected to the inlets of the fluid lines of the apparatus. Fluids which are not pre-chilled can also be dispensed from the inventive apparatus. A flow of coolant, such as glycol, is established through the coolant system of the apparatus, and the beverages or other fluids to be cooled are introduced into the fluid system of the apparatus, with the coolant flow being counter to the fluid flow as discussed above. Cooled fluids are subsequently dispensed from the tap heads. For example, beer is dispensed at a temperature from about 30 to 32° F., at a flowrate of four 16 oz. servings per minute, or up to four oz. per second, with substantial elimination of foaming. Beer temperatures at the tap as low as 27° F. can be achieved by use of the inventive apparatus.

Figure 10:
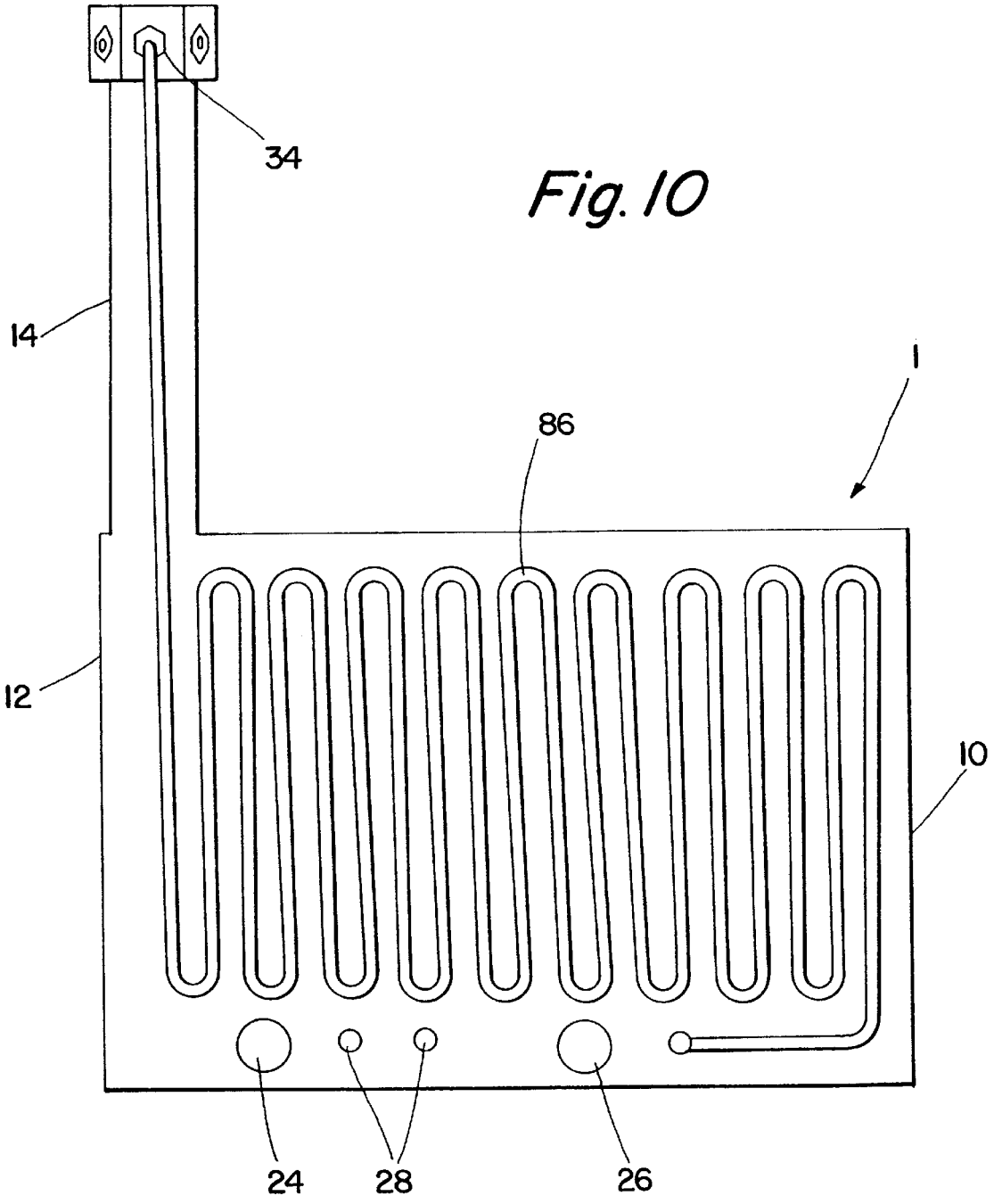
FIG. 10 is a back elevational view of an alternative embodiment of a cooling apparatus of the invention including an external fluid line a portion of which is affixed to a surface of the cold plate portion of the metallic unit.

FIG. 10 illustrates an alternative embodiment of an apparatus of the invention which includes an external fluid line 86. External fluid line 86 is affixed to a surface, such as the front surface, of cold plate portion 12 and tower portion 14 of metallic unit 10, and is connected to one of tap fittings 34. This embodiment allows fluids having various and potentially incompatible chilling requirements to be dispensed from the same unit. For example, a fluid having a relatively high freezing temperature, such as light beer, can be dispensed via the external fluid line 86, while fluids requiring lower temperatures, such as regular (non-light) beers, can be dispensed via fluid lines 28 within metallic unit 10.

According to the invention, further modifications can be made to the apparatus. In particular, a cold plate unit and a dispenser unit can be produced as separate components.

Figure 11A:
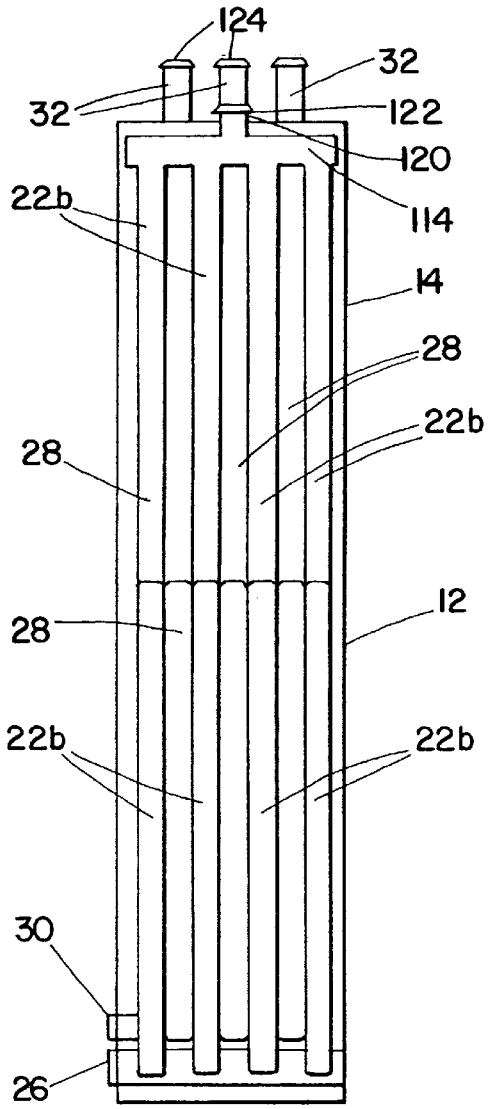
FIGS. 11*a–c* are left partial sectional, top plan and right partial sectional views of an embodiment of a separate cold plate unit of the invention which includes cold plate and tower portions. The embodiment is adapted for vertical placement.
Figure 11C:
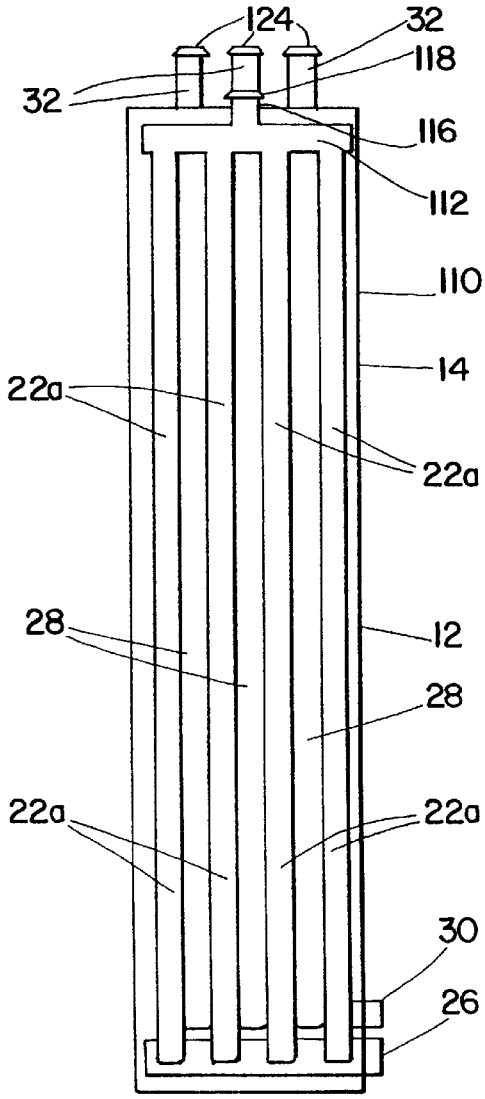
Figure 11B:
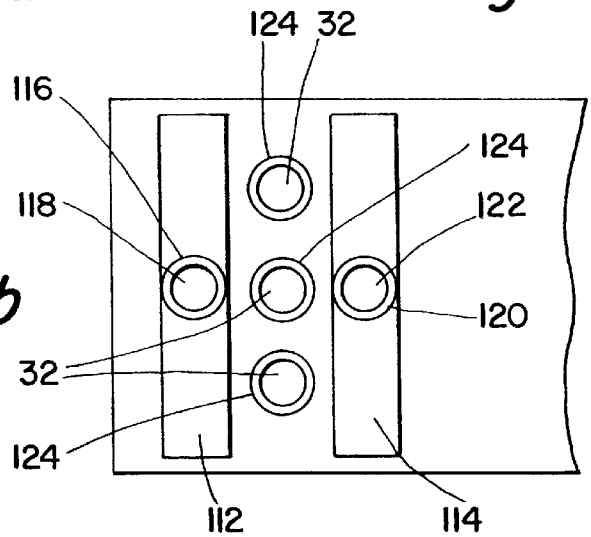

In FIGS. 11*a–c,* a cold plate unit 110 includes a plurality of fluid lines 28 and coolant lines 22, similarly to the embodiment of FIG. 5. In this embodiment, however, the top loops 46 of coolant lines 22 are replaced by secondary inlet and outlet manifolds 112 and 114, respectively. Consequently, the individual continuous coolant lines 22 of the embodiment of FIG. 5 are replaced by first coolant line segments 22*a* connecting the primary inlet manifold 24 and the secondary inlet manifold 112, and second coolant line segments 22*b* connecting the secondary outlet manifold 114 and the primary outlet manifold 26.

Coolant emerges from secondary inlet manifold 112 via line 116, which preferably includes fitting 118 to facilitate connection with a dispenser unit such as the units described below. Secondary outlet manifold 114 includes line 120, which preferably includes fitting 122 to facilitate connection with the dispenser unit. Coolant from the dispenser unit enters secondary outlet manifold 114 via line 120 and returns to cold plate 110. Outlet ends 32 of fluid lines 28 also preferably include fittings 124 for connecting with the dispenser unit.

Figure 12A:
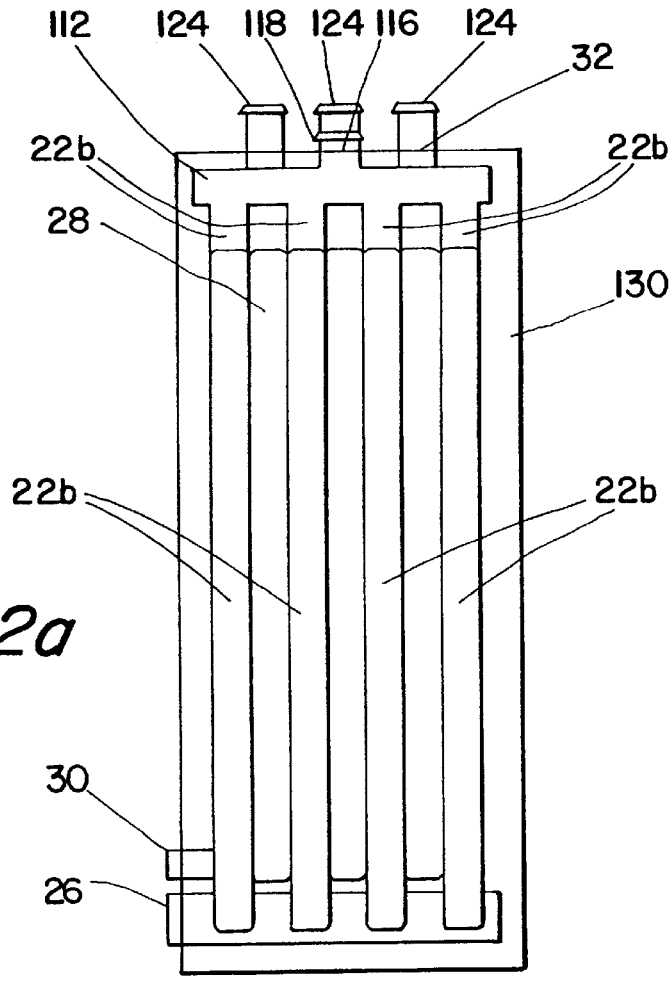
FIGS. 12*a–b* are left partial sectional and top plan views of another embodiment of a separate cold plate unit of the invention which does not include a tower portion.
Figure 12B:
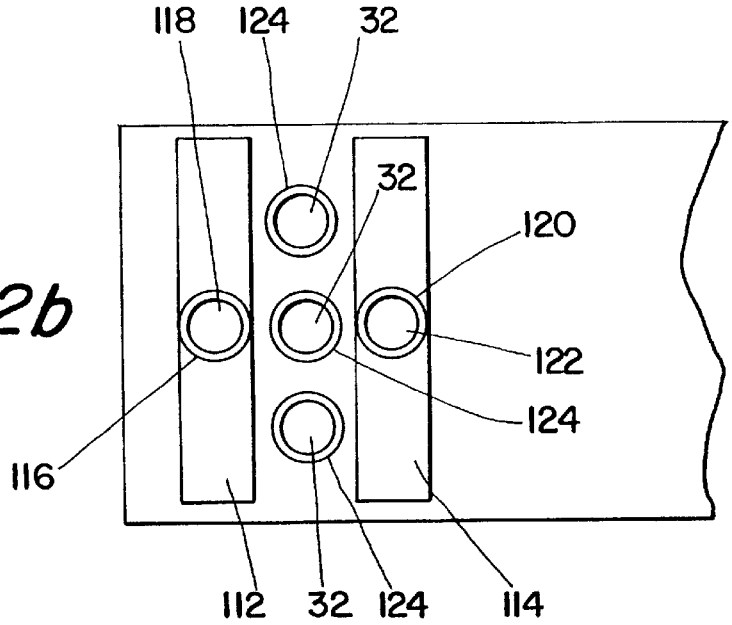

In FIG. 12, cold plate 130, without a tower unit 14 as in FIGS. 5 and 11*a,* includes similar manifolding of the coolant lines 28 at the top of the cold plate 130, rather than at the top of the tower unit.

The separate cold plate units of FIGS. 11–12 preferably do not include restricter segments 64 in the fluid lines 28.

Figure 13:
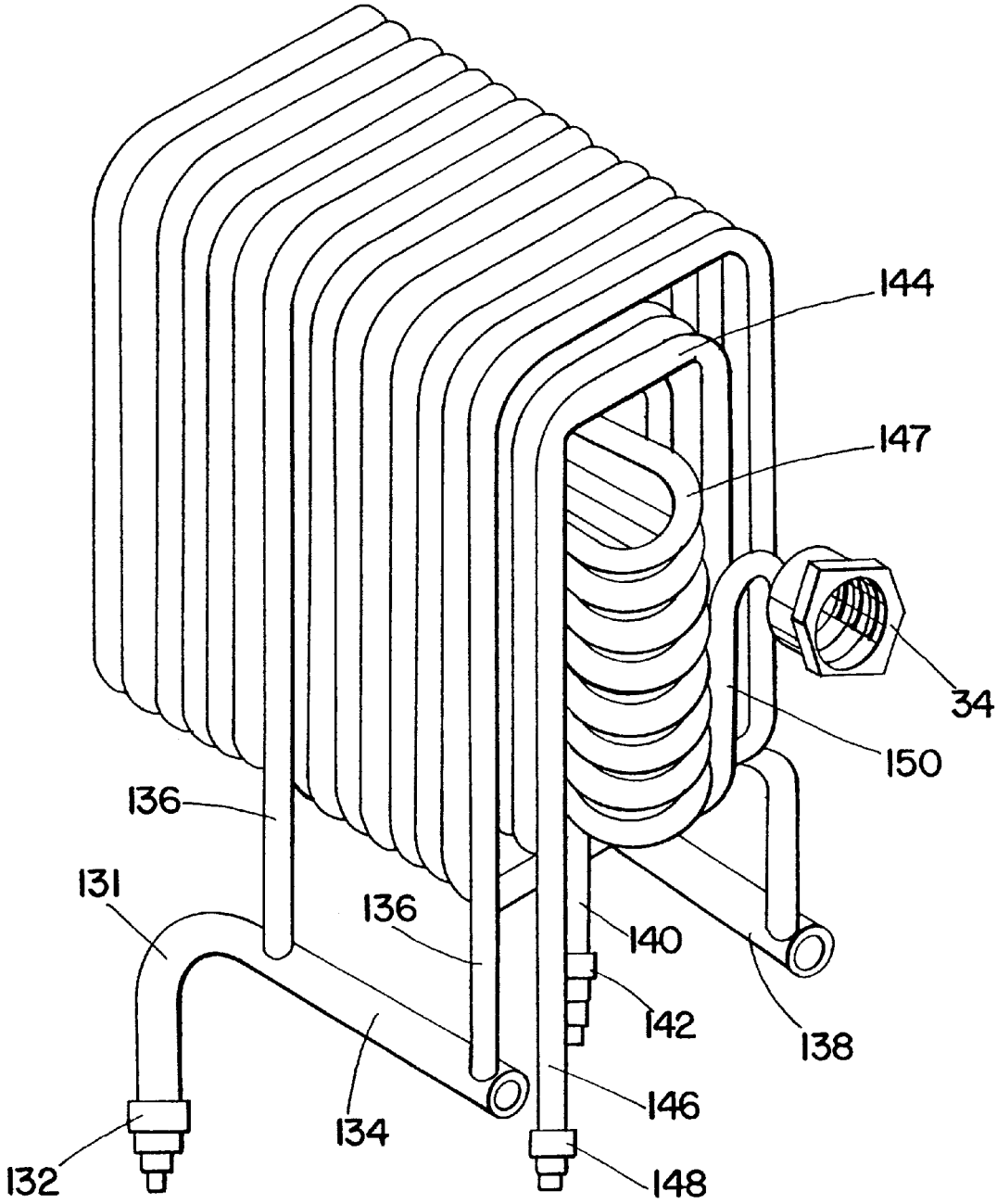
FIG. 13 is a right perspective view of the coil basket of an embodiment of a dispenser unit of the invention having one coiled fluid line disposed at least partially within a coiled coolant system. The fluid line includes a restricter segment.
Figure 14A:
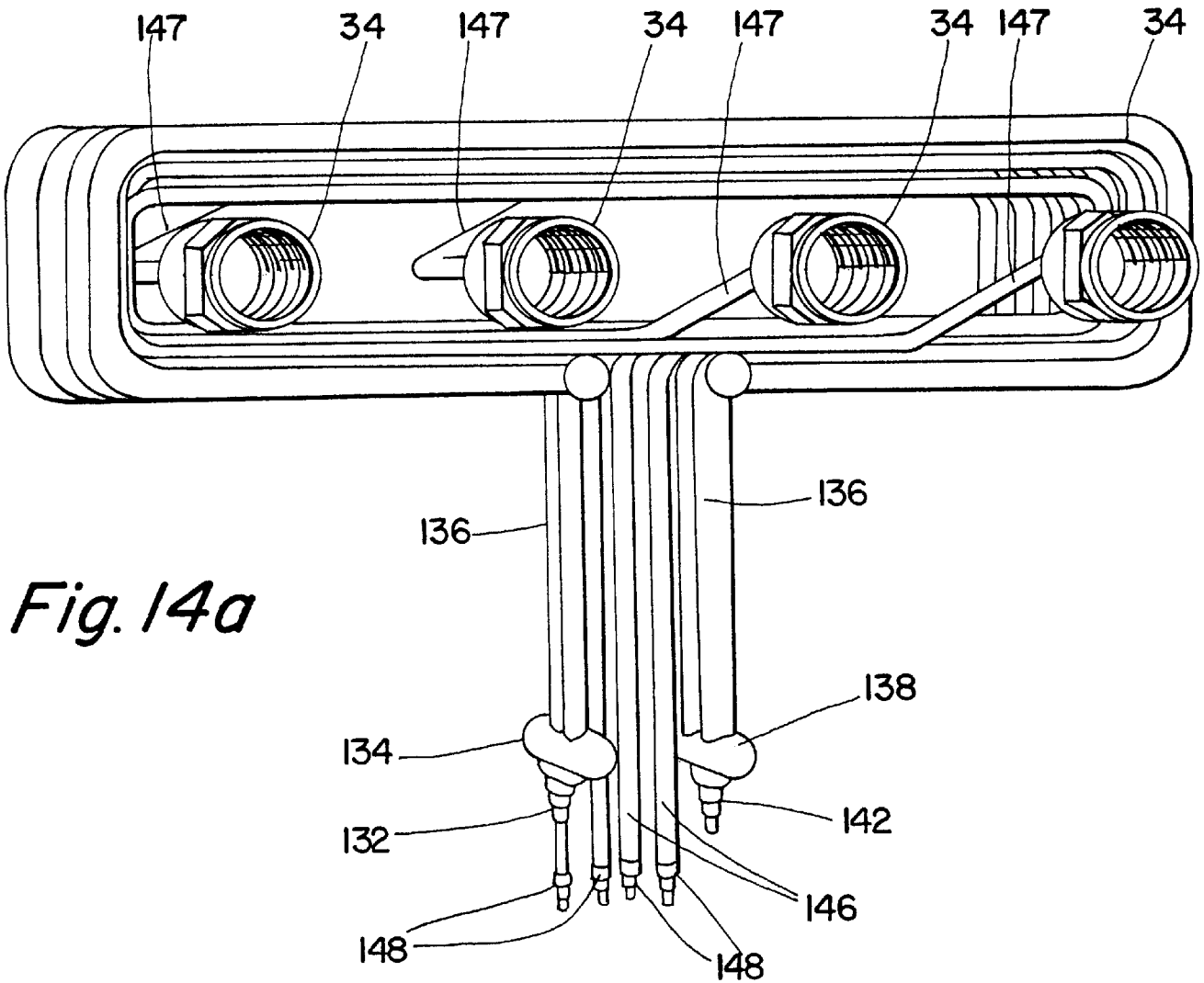
FIGS. 14*a–b* are right perspective views of the coil basket of another embodiment of a dispenser unit of the invention having four fluid lines disposed at least partially within a coiled coolant system, wherein the fluid lines are not coiled but include restricter segments.
Figure 14B:
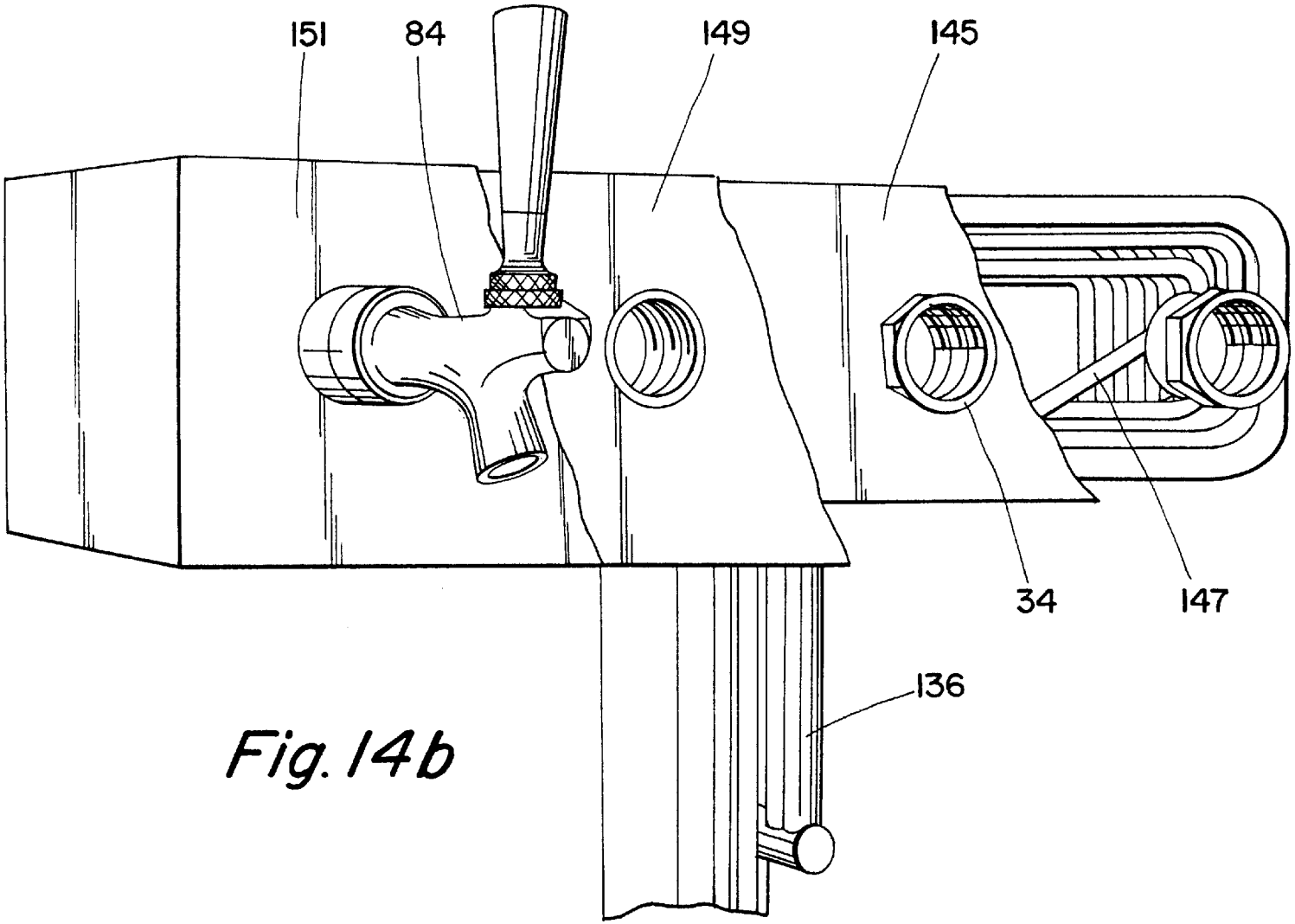

FIGS. 13 and 14*a–b* illustrate the coil baskets of embodiments of a separate dispenser unit suitable for use with the separate cold plates of FIGS. 11–12. As with other embodiments of the present invention, the coil baskets of FIGS. 13 and 14*a–b* are enclosed within a metallic unit, preferably an aluminum unit, formed in accordance with the processes set forth herein. In effect, the separate dispenser units act as auxiliary cold plates which can be disposed on the top of a surface, such as a bar counter, and attached to the primary cold plate unit disposed beneath the surface.

In FIG. 13, dispenser inlet coolant line 131, preferably provided with fitting 132 which is adapted to engage with fitting 118 of a separate cold plate such as described above, is connected to dispenser inlet coolant manifold 134. A plurality of dispenser coolant lines 136 (two lines illustrated) are connected to dispenser inlet coolant manifold 134, and are formed into a plurality of coils, such as rectangular coils, as shown. Dispenser coolant lines 136 then are connected to dispenser outlet coolant manifold 138, which in turn is connected to dispenser outlet coolant line 140. Line 140 preferably is provided with fitting 142 which is adapted to engage with fitting 122 of a separate cold plate such as described above.

Disposed within the plurality of coils of the dispenser coolant lines 136 is one or more fluid lines 144 (one line illustrated). Fluid line 144 is preferably arranged in a plurality of coils as shown, and has an inlet section 146 which preferably is provided with a fitting 148 adapted to engage with a fitting 124 of a fluid line 32 in a cold plate unit as described above. Fluid line 144 also has an outlet section 150 which in turn is connected to tap fitting 34, to which a tap head (not shown) is connected to dispense a cooled fluid.

If desired, portions of the dispenser fluid lines 144 can be formed as restricter segments in the manner described above.

FIG. 14*a* illustrates a coil basket of a dispenser unit for multiple cooled fluid lines, which can be uncoiled (as illustrated) or coiled. Four fluid lines 146 are illustrated; however, up to 10 or more fluid lines can be employed if desired. As shown in FIG. 14, inlet section 131 and outlet section 140 may be eliminated, and fittings 132 and 142 may be connected directly to inlet and outlet manifolds 134 and 138, respectively.

In FIG. 14*b,* the coil basket of FIG. 14*a* is incorporated in metallic unit 145, with a layer of insulation 149 surrounding the metallic unit and a shell 151 in turn surrounding the insulation layer. The insulation layer 149 can be formed as described herein.

A dispenser unit according to the invention can have any desired orientation, such as vertical, horizontal or inclined, depending on the nature of the space available for mounting the unit, the decorative effect sought to be achieved, and other design factors. Furthermore, the inventive dispenser unit any desired shape can be produced. Such shapes include, without limitation, a cube, a rectangular prism, a cylinder, etc. The coiled coolant and fluid lines can be formed as square or rectangular coils, circular coils, or any other desired configuration. Furthermore, the dispenser unit can be encased by a sheathing having a shape that is the same as, or different from, the shape of the unit itself. For example, a cubical dispenser unit can be encased in a horizontally oriented, barrel-shaped sheathing.

Figure 15A:
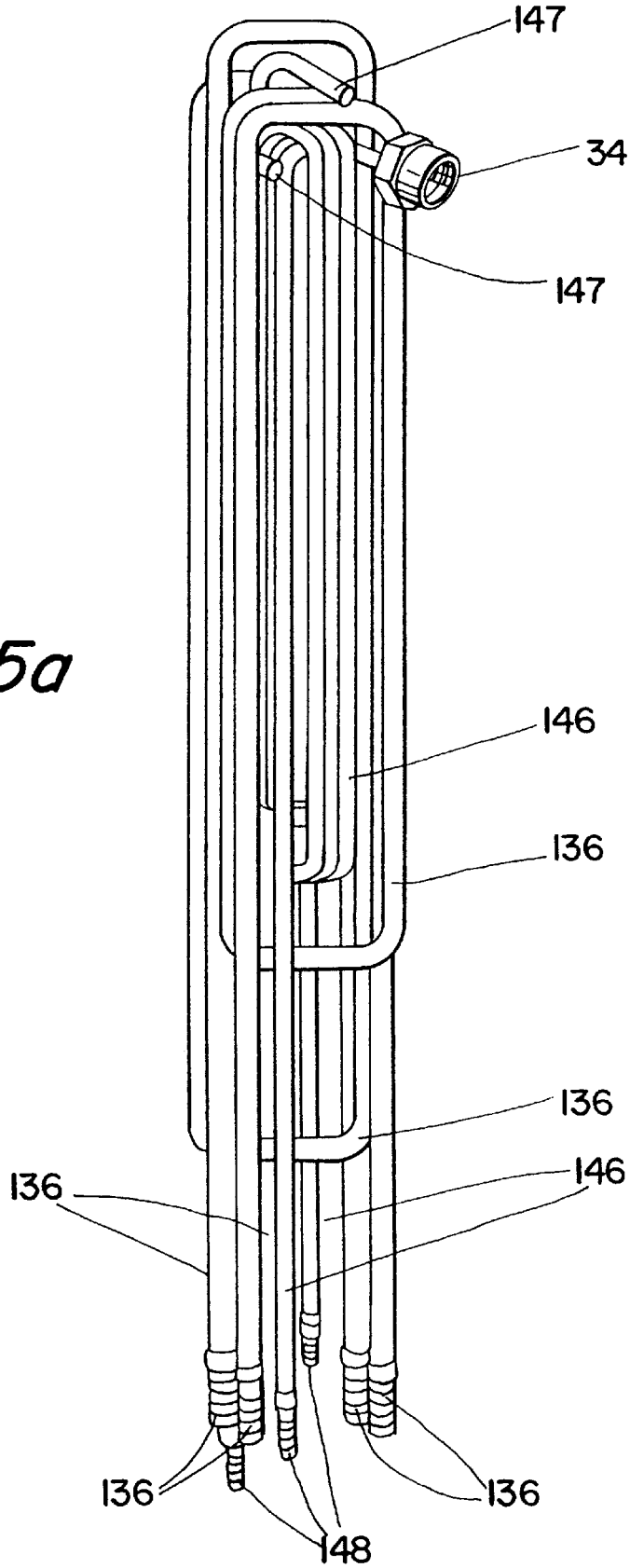
FIGS. 15*a–b* show a cylindrical, or tower, dispenser unit coil basket and a partial cut-away view of a complete cylindrical unit, respectively.
Figure 15B:
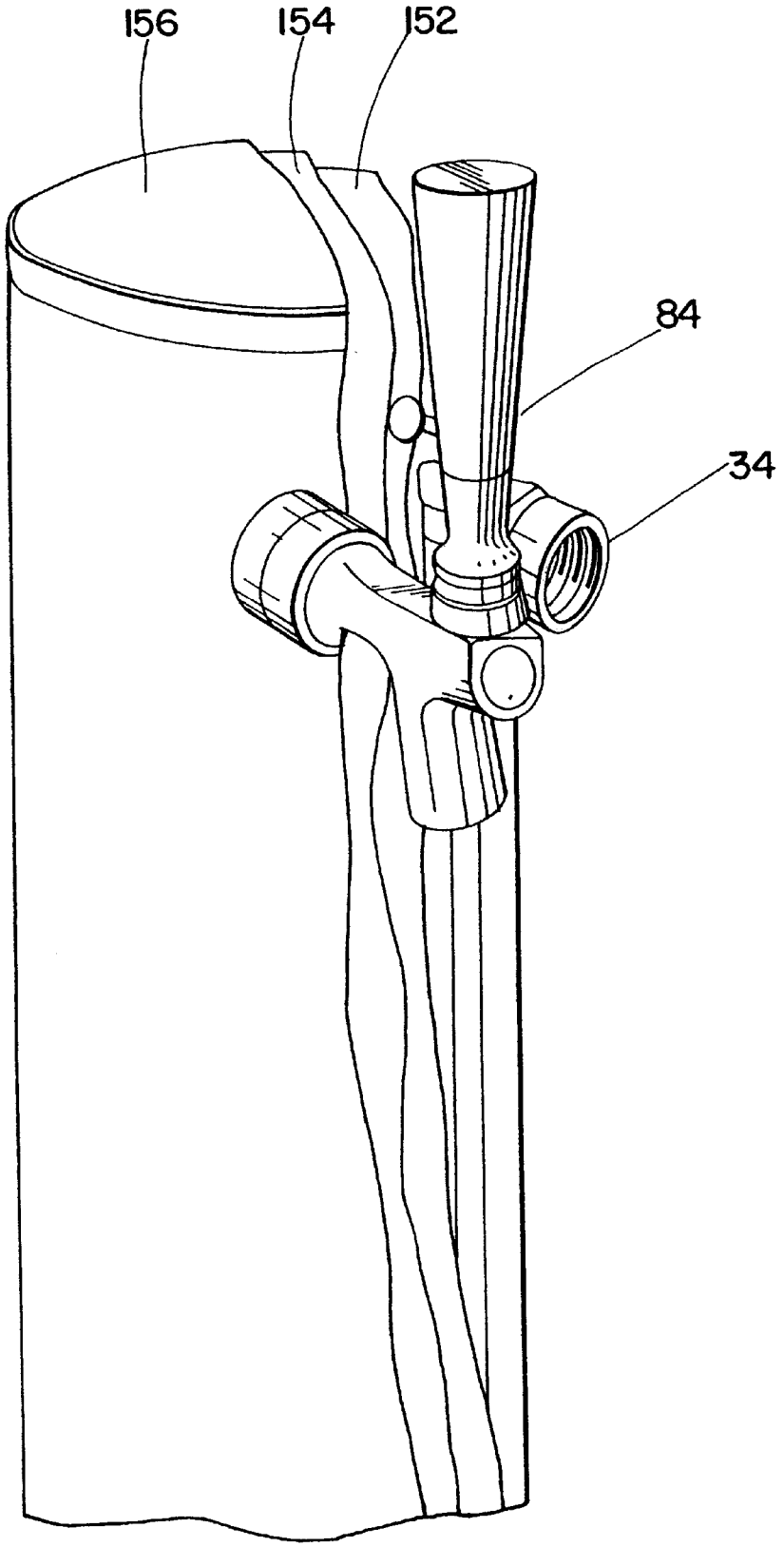

A cylindrical, or tower, dispensing unit is illustrated in FIGS. 15*a–b.* The coil basket embodiment illustrated in FIG. 15*a* is an alternative configuration in which the coolant lines 136 are not manifolded, and in which the individual coolant lines 136 are formed into coils of varying length. In FIG. 15*b,* metallic unit 152 encloses the coil basket. A layer of insulation 154 surrounds metallic unit 152, and in turn is surrounded by shell 156. The insulation layer 154 can be formed as described herein.

Figure 16:
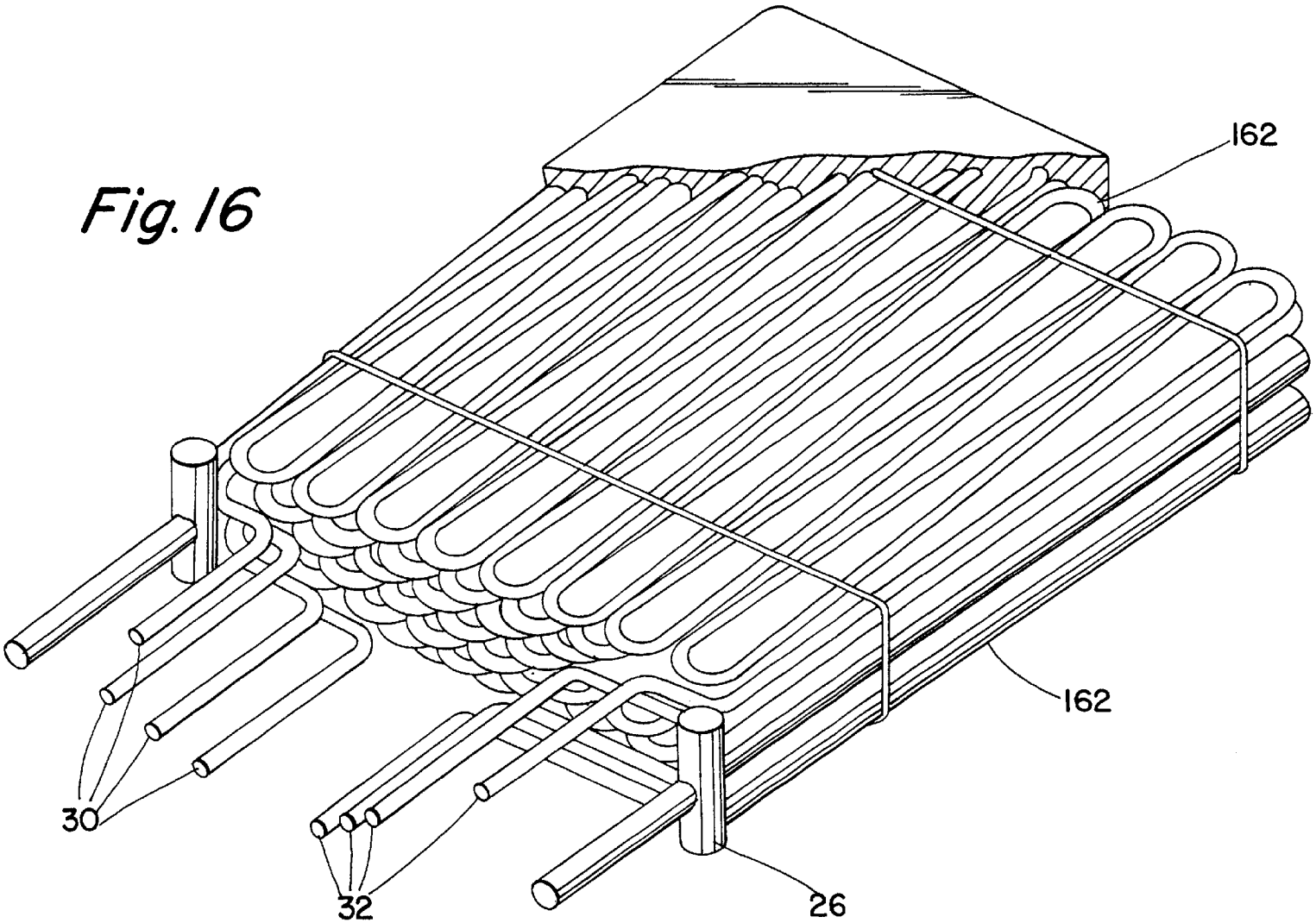
FIG. 16 is a left perspective view of another embodiment of an alternative cold plate unit of the invention in which a plurality of fluid line inlets and outlets are disposed between coolant system inlet and outlet manifolds. The cold plate is adapted for horizontal placement.

As illustrated above, the separate cold plates 110 and 130 include fluid lines 28 with inlets 30 at the bottom of the cold plates and outlets 32 at the top of the cold plates. An alternative embodiment of a separate cold plate 160 is illustrated in FIG. 16, in which fluid inlets 30 and outlets 32 are both located at the same end of the cold plate 160, between the coolant primary inlet and outlet manifolds 24 and 26. This embodiment is useful in both vertical and horizontal orientations.

FIG. 16 also illustrates use of bands 162 to maintain the coil basket in a compact shape prior to the metal casting procedure used to form the metallic unit.

A dispenser unit according to the invention can be employed together with a cold plate unit as described above. Alternatively, the dispenser unit can be used by itself as a complete liquid cooling device. In another alternative, the dispenser unit can be used together with a plurality of additional cold plate units as described herein to form a multi-unit system.

FIGS. 17–22 illustrate a number of exemplary systems employing one or more of the cold plate and/or dispenser units described herein. The exemplary systems employ cooled glycol as the coolant. Other conventional coolants can be employed if desired.

Figure 17:
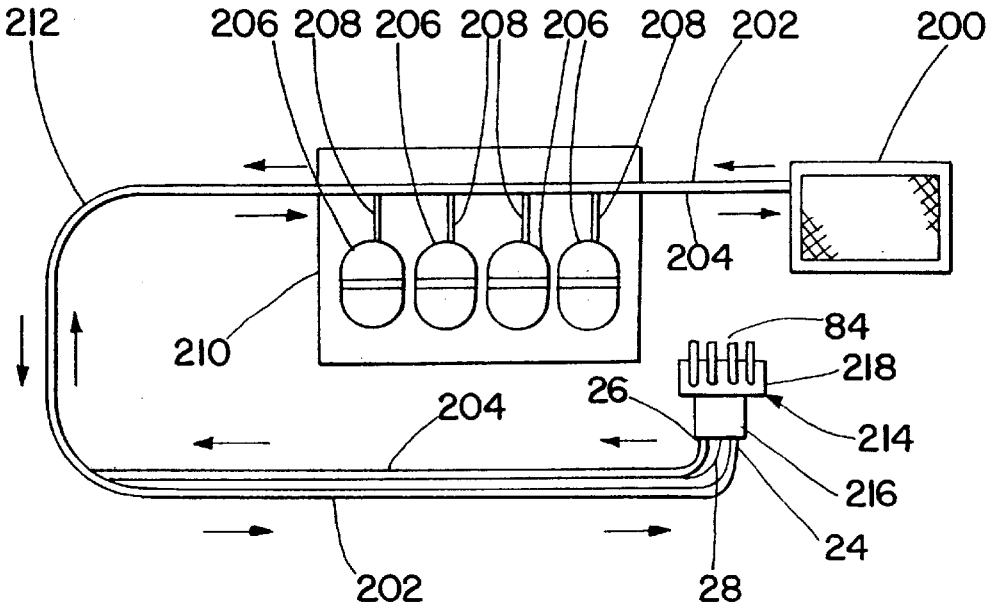
FIG. 17 is a schematic representation of a liquid cooling system which employs a cooling apparatus, including cold plate and dispener unit, of the invention.

In FIG. 17, a conventional refrigerated glycol heat exchanger unit 200 supplies cooled glycol via glycol delivery line 202 to primary inlet manifold 24 of cooling apparatus 214, which includes cold plate unit 216 and dispenser unit 218. The cooled glycol circulates through cooling apparatus 214 and exits via primary outlet manifold 26 to glycol return line 204 and thence to glycol heat exchanger unit 200 for refrigeration and recycling. Fluid to be cooled, in this example beer, is supplied from a plurality of kegs 206 stored in cold room 210 via fluid supply lines 208 to fluid lines 28 of cooling apparatus 214. The fluid is chilled within cooling apparatus 214 and is dispensed from tap heads 84. At least a portion of the lengths of the glycol delivery line 202, glycol return line 204, and fluid supply lines 208 between the glycol heat exchanger unit 200 and the cooling apparatus 214 are bundled together and insulated to form trunk line 212.

If desired, the dispenser unit 218 can be employed by itself, without the cold plate unit 216. In another alternative, cooling apparatus 214 can be replaced by an "integral unit"-type cold plate 1 as described herein.

Figure 18:
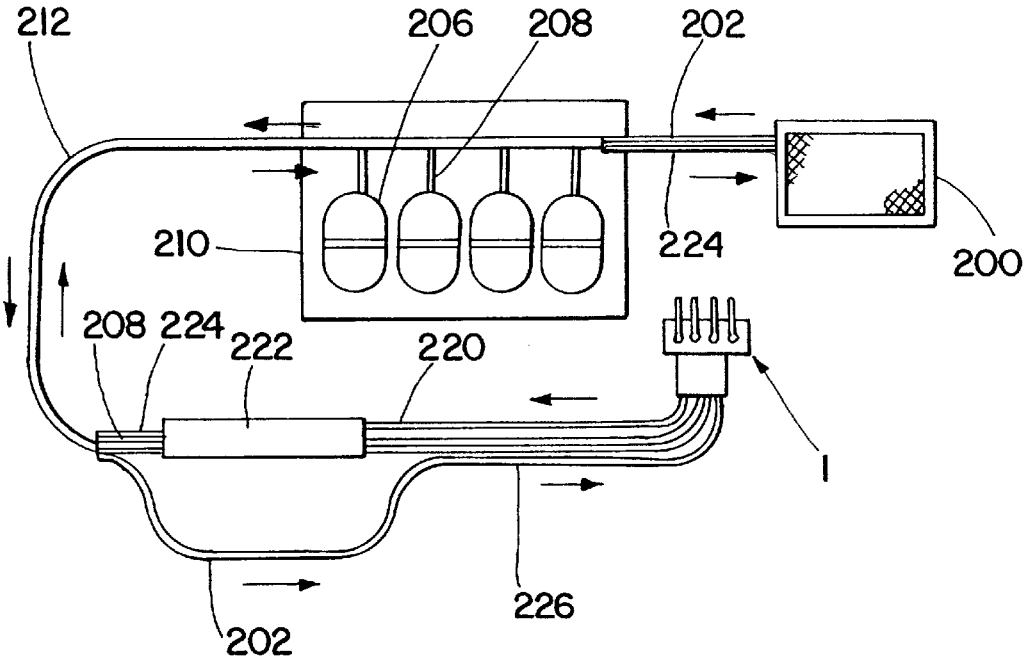
FIG. 18 is a schematic representation of another liquid cooling system which includes an integral cold plate unit of the invention together with an additional cold plate upstream of the apparatus for additional cooling capacity.
Figure 19:
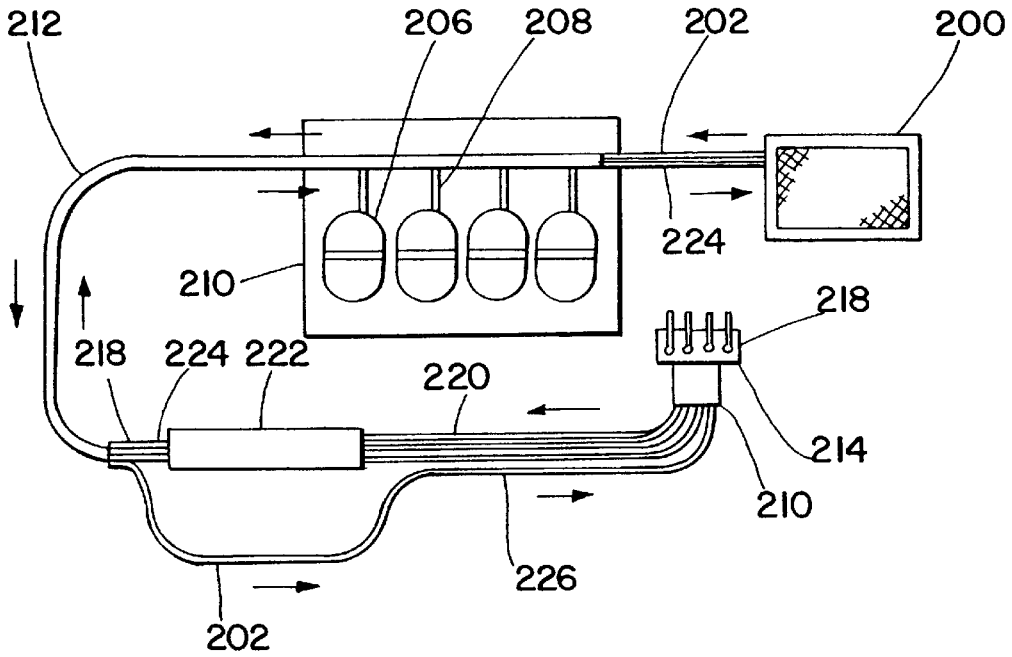
FIG. 19 is a schematic representation of a third liquid cooling system which includes a cooling apparatus of the invention together with an additional upstream cold plate.

The systems of FIGS. 18 and 19 are similar to that of FIG. 17, but provide additional cooling capability for high-volume use by including an additional cold plate. In this embodiment, cooled glycol is supplied via glycol delivery line 202 to integral cold plate 1. From integral cold plate 1 the glycol is supplied via return line 220 to auxiliary cold plate 222. After cooling auxiliary cold plate 222 the glycol is returned via return line 224 to glycol heat exchanger unit 200. Fluid to be cooled is supplied via fluid lines 208 to auxiliary cold plate 222, and thence via fluid lines 226 to cooling apparatus 214 for final cooling and dispensing.

In FIG. 19, integral cold plate 1 is replaced by cooling apparatus 214 including cold plate unit 216 and dispenser unit 218.

Figure 20:
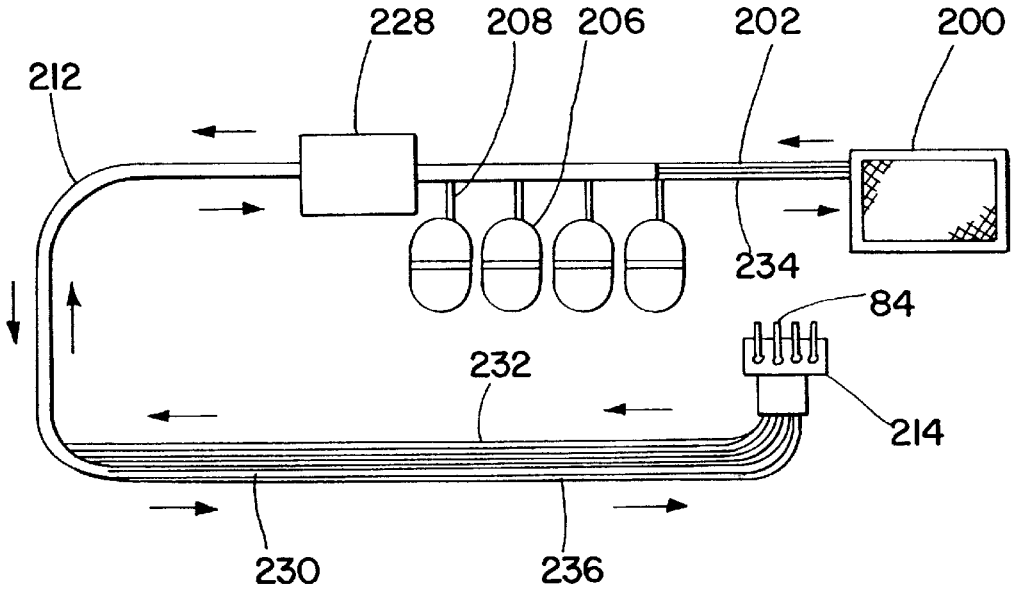
FIGS. 20–22 are schematic representations of alternative liquid cooling systems, corresponding to FIGS. 17–20, respectively, which include a pre-chill unit and which are useful for cooling liquids, such as beer, stored at ambient temperature.
Figure 21:
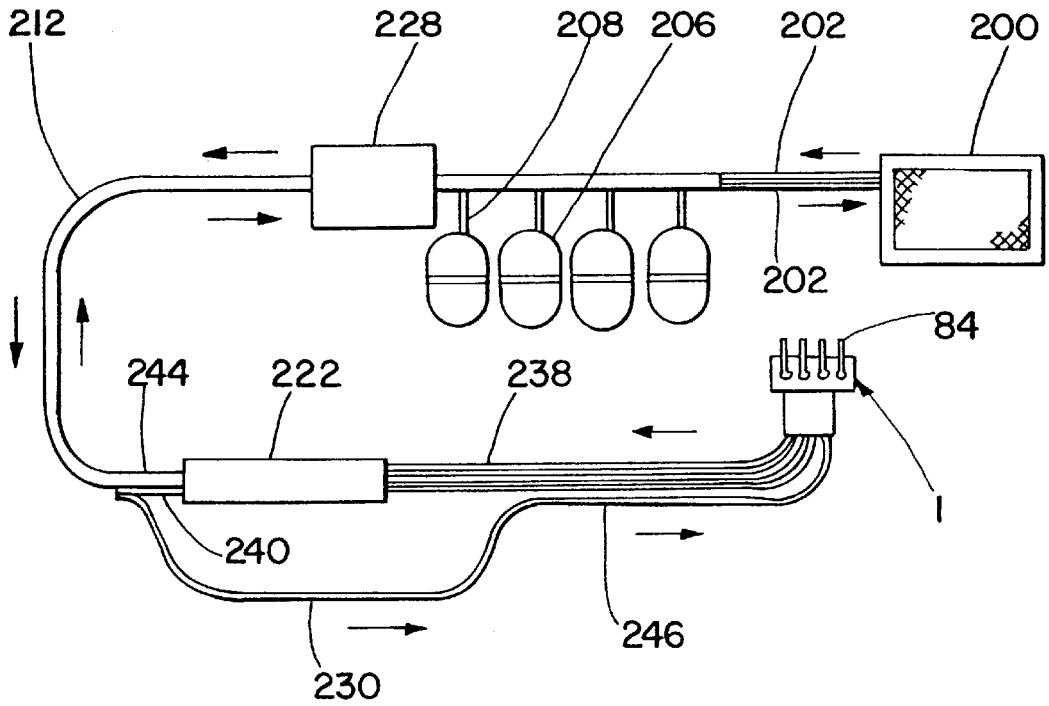
Figure 22:
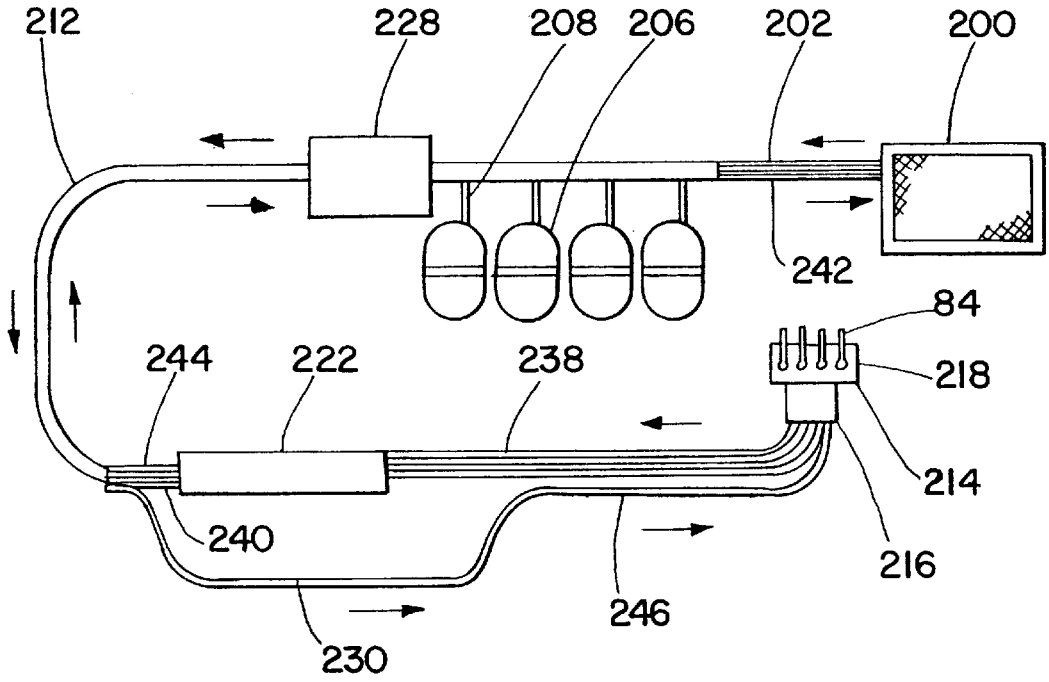

The systems of FIGS. 20–22 are analogous to the systems of FIGS. 17–19, but include a pre-chill cold plate 228. These systems are particularly useful when the fluid to be dispensed is stored at ambient temperature rather than in a cold room.

In FIG. 20, cooled glycol from glycol heat exchanger unit 200 is initially supplied via glycol supply line 202 to pre-chill cold plate 228. From pre-chill cold plate 228 glycol flows via glycol supply line 230 to cooling apparatus 214, the returns via glycol return line 232 to pre-chill cold plate 228, and finally via return line 234 to heat exchanger unit 200. Fluid to be cooled is supplied from kegs 206 via lines 208 to pre-chill cold plate 228, where it is cooled to an intermediate temperature between ambient temperature and the desired dispensing temperature. From pre-chill cold plate 228 the fluid is supplied via lines 236 to cooling apparatus 214, where it is cooled to the desired temperature and dispensed from tap heads 84.

In FIG. 21, cooled glycol from glycol heat exchanger unit 200 is initially supplied via glycol supply line 202 to pre-chill cold plate 228. From pre-chill cold plate 228 glycol flows via glycol supply line 230 to integral cold plate 1, returns via glycol return line 238 to auxiliary cold plate 222, thence via return line 240 to pre-chill cold plate 228, and finally via return line 242 to heat exchanger unit 200. Fluid to be cooled is supplied from kegs 206 via lines 208 to pre-chill cold plate 228, where it is cooled to an intermediate temperature between ambient temperature and the desired dispensing temperature. From pre-chill cold plate 228 the fluid is supplied via lines 244 to auxiliary cold plate 222, where it is further cooled, and thence via lines 246 to integral cold plate 1, where it is cooled to the desired temperature and dispensed from tap heads 84.

Finally, in FIG. 22, cooling apparatus 214 is used in place of integral cold plate 1. If desired, dispenser unit 218 can be used alone, without cold plate 216.

What is claimed is:

1. A cold plate unit comprising:

i) a coolant system comprising a primary inlet manifold, a secondary inlet manifold, a secondary outlet manifold and a primary outlet manifold, the coolant system further comprising a first plurality of coolant line segments connecting the primary inlet manifold and the secondary inlet manifold and a second plurality of coolant line segments connecting the secondary outlet manifold and the primary outlet manifold;

ii) a fluid system for conveying a fluid to be dispensed in heat exchange relationship with the coolant system; and iii) a metallic unit which incorporates the coolant system and the fluid system.

2. The cold plate unit of claim 1 wherein said first and second pluralities of coolant line segments comprise from 2 to 12 coolant line segments.

3. The cold plate unit of claim 1 wherein said fluid system comprises a plurality of separate fluid lines which are interlaced with said first and second pluralities of coolant line segments.

4. The cold plate of claim 3 wherein the number of said plurality of fluid lines is less than the number of said plurality of coolant lines.

5. The cold plate of claim 1 wherein said fluid system is comprised of stainless steel.

6. The cold plate of claim 1 wherein said metallic unit comprises aluminum or an aluminum alloy.

7. The cold plate of claim 1 further comprising an insulating material disposed about at least a portion of said metallic unit.

8. The cold plate unit of claim 1 wherein the metallic unit comprises a solid metallic unit encasing the coolant and fluid systems.

9. A dispenser unit comprising:

i) a coolant system comprising a dispenser inlet manifold and a dispenser outlet manifold, the coolant system further comprising a plurality of coiled coolant lines connected to the dispenser inlet manifold and the dispenser outlet manifold, ii) a fluid system for conveying a fluid to be dispensed in heat exchange relationship with the coolant system, the fluid system being disposed at least partially within the coiled coolant lines, and iii) a solid metallic unit which incorporates the coolant system and the fluid system.

10. The dispenser unit of claim 9 wherein said fluid system comprises a plurality of separate fluid lines.

11. The dispenser unit of claim 10 wherein at least one of said plurality of fluid lines comprises a restricter segment.

12. The dispenser unit of claim 11 wherein the restricter segment has a diameter about 1/16 inch smaller than the diameter of the remainder of the at least one fluid inch.

13. The dispenser unit of claim 11 wherein the restricter segment has a length of about 7 to about 9 feet.

14. The dispenser unit of claim 9 wherein said fluid system is comprised of stainless steel.

15. The dispenser unit of claim 9 wherein said metallic unit comprises aluminum or an aluminum alloy.

16. The dispenser unit of claim 9 further comprising an insulating material disposed about at least a portion of said metallic unit.

17. The dispenser unit of claim 9 wherein the plurality of coiled coolant lines comprises at least three coiled coolant lines.

18. The dispenser unit of claim 9 wherein the dispenser coolant inlet and outlet manifolds each comprise a piece of tubing having a diameter of from about 0.5 to 1 inch and a length of from about 3 to 5 inches and the coolant lines are welded into the side of the manifold tubing.

19. A cold plate unit comprising i) a coolant system comprising a primary inlet manifold and a primary outlet manifold, said coolant system further comprising a plurality of coolant line segments connecting said primary inlet manifold and said primary outlet manifold, ii) a fluid system in heat exchange relationship with said coolant system, said fluid system comprising at least one fluid line with a fluid inlet and a fluid outlet, and iii) a solid metallic unit which incorporates said coolant system and said fluid system, said cold plate unit having an end, wherein said primary inlet and outlet manifolds and said fluid inlet and outlet are located at said end of said cold plate and wherein said fluid inlet and outlet are located between said primary inlet and outlet manifolds.

20. The cold plate unit of claim 19 wherein the plurality of coolant line segments connecting said inlet and outlet manifolds comprises at least three coolant line segments.

21. The cold plate unit of claim 20 wherein the inlet and outlet manifolds each comprise a piece of tubing having a diameter of from about 0.5 to 1 inch and a length of from about 3 to 5 inches and the coolant line segments are welded into the side of the manifold tubing.

22. A cold plate unit, comprising:

a) a coolant system, the coolant system having i) a primary coolant inlet manifold and a primary coolant outlet manifold;

ii) at least one coolant primary inlet connected to the primary coolant inlet manifold;

iii) at least one coolant primary outlet connected to the primary coolant outlet manifold;

iv) a plurality of coolant lines disposed between the coolant primary inlet manifold and coolant primary outlet manifold providing a plurality of fluid paths therebetween;

b) a fluid system in heat exchange relationship with the coolant system, the fluid system i) at least one fluid inlet and at least one fluid outlet; and ii) a fluid line disposed between the fluid inlet and the fluid outlet providing a fluid connection therebetween; and c) wherein the fluid and coolant systems form a coil basket and the coil basket is encased in a solid metallic unit.

23. The cold plate unit of claim 22 wherein the plurality of coolant lines disposed between the coolant primary inlet manifold and the coolant primary outlet manifold provides at least three fluid paths therebetween.

24. The cold plate unit of claim 22 wherein the coolant primary inlet and outlet manifolds each comprise a piece of tubing having a diameter of from about 0.5 to 1 inch and a length of from about 3 to 5 inches and the coolant lines are welded into the side of the manifold tubing.

25. A cold plate unit comprising:

i) a coolant system having at least one primary inlet manifold and at least one primary outlet manifold, the coolant system further having a plurality of coolant line segments extending between each said primary inlet manifold and said primary outlet manifold;

ii) a fluid system for conveying a fluid to be dispensed in heat exchange relationship with the line segments of the coolant system, with the fluid system having fluid lines arranged between adjacent said coolant line segments; and iii) a solid metallic unit encasing the inlet and outlet manifolds, plurality of coolant line segments and fluid lines.

26. The cold plate unit of claim 25 wherein the fluid lines each have an inlet and an outlet and wherein each said primary inlet, each said primary outlet and said fluid inlets and fluid outlets from the fluid lines are located adjacent one side of the cold plate unit.

27. The cold plate unit of claim 25 wherein the fluid lines each extend in planes interlaced between the coolant line segments, with each said coolant line segment extending in a plane adjacent to and spaced from a plane containing one of the fluid lines.

28. The cold plate unit of claim 27 wherein the number of said fluid lines is less than the number of said plurality of coolant line segments.

29. The cold plate unit of claim 25 further comprising an insulating material disposed about the metallic unit encasing the fluid system and the coolant system.

30. The cold plate unit of claim 25 wherein the primary inlet and outlet manifolds each comprise a piece of tubing having a diameter of from about 0.5 to 1 inch and a length from about 3 to 5 inches and the coolant line segments are welded into the side of the manifold tubing.

31. The cold plate unit of claim 25 wherein the plurality of coolant line segments comprises at least three segments.

32. A cold plate unit comprising:

a) a coolant system having at least one inlet manifold, at least one outlet manifold and a plurality of coolant lines running between said inlet and outlet manifolds;

b) a fluid system having at least one fluid line; and c) a solid metallic unit encasing the coolant lines and the at least one fluid line providing a heat exchange relationship between the at least one fluid line and the coolant lines.

33. The cold plate unit of claim 32 wherein the coolant lines each comprise a plurality of loops encased in the metallic unit.

34. The cold plate unit of claim 32 wherein there are a plurality of fluid lines encased in the metallic unit.

35. The cold plate unit of claim 32 wherein the at least one fluid line comprises a plurality of loops encased in the metallic unit.

36. The cold plate unit of claim 32 wherein the at least one fluid line is interleaved with the coolant lines inside the metallic unit.

37. The cold plate unit of claim 32 wherein the fluid system comprises a plurality of fluid lines having a plurality of loops encased in the metallic unit.

38. The cold plate unit of claim 37 wherein a plurality of the coolant lines each comprise loops encased in the metallic unit.

39. The cold plate unit of claim 32 wherein the metallic unit comprises aluminum or an aluminum alloy.

40. The apparatus of claim 39 wherein the at least one coolant line comprises at least three coolant lines encased in the metallic unit.

41. The apparatus of claim 39 wherein the at least one coolant line comprises a plurality of coolant lines encased in the metallic unit connected between inlet and outlet manifolds within the metallic unit each comprising a piece of tubing having a diameter of from about 0.5 to 1 inch and a length of from about 3 to 5 inches with the coolant lines being welded into the side of the manifold tubing.

42. The cold plate unit of claim 32 wherein the coolant lines and at least one fluid line are in the form of a coil basket inside the metallic unit.

43. The cold plate unit of claim 32 wherein the metallic unit is formed in a mold.

44. The cold plate unit of claim 32 wherein the fluid lines each have an outlet end, and a fitting mounted on the outlet end.

45. The cold plate unit of claim 44 wherein the fittings are encased in the metallic unit.

46. The cold plate unit of claim 32 wherein the coolant lines and fluid lines in the metallic unit have been pressure tested for leaks.

47. The cold plate unit of claim 32 wherein the fluid lines have been passivated to de-scale deposits.

48. The cold plate unit of claim 32 wherein the fluid and coolant lines are different sizes.

49. The cold plate unit of claim 32 wherein the inlet and outlet manifolds each comprise a piece of tubing having a diameter of from about 0.5 to 1 inch and a length of from about 3 to 5 inches and the coolant line segments are welded into the side of the manifold tubing.

50. The cold plate unit of claim 32 wherein the plurality of coolant lines running between said inlet and outlet manifolds comprises at least three coolant lines.

51. An apparatus for cooling fluids, comprising:

a) a fluid system having a cold plate portion and a tower portion;

b) a coolant system having a cold plate portion and a tower portion, the cold plate portion of the coolant system including at least three coolant line segments each extending between an inlet manifold and an outlet manifold;

c) a metallic unit encasing the cold plate portions of the fluid system and coolant system, including said manifolds, in heat exchange relationship; and d) the tower portions of the fluid and coolant systems also being in heat exchange relationship with one another.

52. The apparatus for cooling fluids of claim 51 wherein the tower portion of the fluid system includes a plurality of fluid lines.

53. The apparatus for cooling fluids of claim 51 wherein the coolant system further includes a coolant return line partially encased in the metallic unit.

54. The apparatus for cooling fluids of claim 53 wherein the fluid system comprises a plurality of fluid lines encased in the metallic unit.

55. The apparatus of claim 54 wherein the fluid and the coolant systems have inlets and outlets on nonparallel sides of the metallic unit.

56. The apparatus of claim 55 wherein the fluid and coolant system inlets and outlets are arranged to exit the metallic unit at right angles in relationship with each other.

57. The apparatus of claim 51 wherein the fluid and coolant system inlets are on different sides of the metallic unit.

58. The apparatus of claim 51 wherein the inlet and outlet manifolds each comprise a piece of tubing having a diameter of from about 0.5 to 1 inch and a length of from about 3 to 5 inches and the coolant line segments are welded into the side of the manifold tubing.

59. The apparatus of claim 51 wherein the metallic unit comprises a solid metallic unit encasing the cold plate portions of the fluid and coolant system.

60. An apparatus for cooling a beverage comprising:

a) cold plate unit comprising:

i) a coolant system having at least one inlet and an inlet manifold, at least one outlet and an outlet manifold and at least three coolant line segments running between said inlet and outlet manifolds;

ii) a beverage system having at least one beverage line; and iii) a solid metallic unit encasing the at least three coolant line segments and the at least one beverage line, providing a heat exchange relationship between the at least one beverage line and the at least three coolant line segments;

b) a cooling fluid supplied to the at least one coolant inlet; and c) a beverage supplied to the at least one beverage line.

61. The apparatus of claim 60 wherein the cold plate unit includes a plurality of beverage lines and a plurality of beverages are supplied to the beverage lines.

62. The apparatus of claim 60 wherein the cooling fluid is glycol and the beverage is beer.

63. The apparatus of claim 60 further comprising at least one dispensing tap connected to the beverage line at a point that it exits the metallic unit.

64. The apparatus of claim 60 further comprising a pump circulating the cooling fluid.

65. The apparatus of claim 60 further comprising a fitting joined to the beverage line, the joint between the beverage line and the fitting also being encased in the metallic unit.

66. The apparatus of claim 60 further comprising a tower unit from which the beverage is dispensed, with a beverage line extending between the cold plate and the tower unit.

67. The apparatus of claim 66 further comprising a coolant line carrying cooling fluid between the cold plate unit and the tower unit.

68. The apparatus of claim 67 wherein the cooling fluid is circulated from a cooling fluid heat exchanger, through the coolant line in the cold plate unit, to the tower and back through a return line to the heat exchanger, and the cooling fluid return line has a section which is encased in the metallic unit.

69. The apparatus of claim 60 wherein the inlet and outlet manifolds each comprise a piece of tubing having a diameter of from about 0.5 to 1 inch and a length of from about 3 to 5 inches and the coolant line segments are welded into the side of the manifold tubing.

70. The apparatus of claim 38 wherein the at least one beverage line comprises a restricter segment.

71. The apparatus of claim 70 wherein the restricter segment has a diameter about 1/16 inch smaller than the diameter of the remainder of the at least one fluid line.

72. The apparatus of claim 70 wherein the restricter segment has a length of about 7 to about 9 feet.

* * * * *

UNITED STATES PATENT AND TRADEMARK OFFICE

CERTIFICATE OF CORRECTION

PATENT NO. : 6,553,782 B1
DATED : April 29, 2003
INVENTOR(S) : Melvin D. Kyees

It is certified that error appears in the above-identified patent and that said Letters Patent is hereby corrected as shown below:

Column 17,
Line 47, delete “inch.” and substitute -- line. -- in its place.

Column 18,
Line 34, after “system” insert -- having --

Column 19,
Line 50, delete “The apparatus” and substitute -- The cold plate unit -- in its place.
Line 53, delete “apparatus” and substitute -- cold plate -- in its place.
Lines 53-55, delete “at least one coolant line comprises a plurality of coolant lines encased in the metallic unit connected between”;
Line 56, delete “comprising” and substitute -- comprise -- in its place.

Column 22,
Line 14, delete “claim 38” and substitute -- claim 60 -- in its place.

Signed and Sealed this

Thirteenth Day of July, 2004

JON W. DUDAS
*Acting Director of the United States Patent and Trademark Office*